US010591223B2

(12) United States Patent
Washizuka et al.

(10) Patent No.: US 10,591,223 B2
(45) Date of Patent: Mar. 17, 2020

(54) HEAT PIPE, HEAT DISSIPATING COMPONENT, AND METHOD FOR MANUFACTURING HEAT PIPE

(71) Applicant: Murata Manufacturing Co., Ltd., Nagaokakyo-shi, Kyoto-fu (JP)

(72) Inventors: Seitaro Washizuka, Nagaokakyo (JP); Yoshihiro Kawaguchi, Nagaokakyo (JP); Takashi Kitamura, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 0 days.

(21) Appl. No.: 15/864,369

(22) Filed: Jan. 8, 2018

(65) Prior Publication Data

US 2018/0128554 A1 May 10, 2018

Related U.S. Application Data

(63) Continuation of application No. PCT/JP2016/075615, filed on Sep. 1, 2016.

(30) Foreign Application Priority Data

Sep. 28, 2015 (JP) ..... 2015-189647
Mar. 28, 2016 (JP) ..... 2016-064747

(51) Int. Cl.
*F28D 15/04* (2006.01)
*C23C 24/10* (2006.01)
(Continued)

(52) U.S. Cl.
CPC ..... *F28D 15/046* (2013.01); *C23C 24/106* (2013.01); *F28D 15/0283* (2013.01);
(Continued)

(58) Field of Classification Search
CPC .... F28D 15/046; F28D 15/0283; F28F 19/00; F28F 21/085
See application file for complete search history.

(56) References Cited

U.S. PATENT DOCUMENTS 3,426,420 A 2/1969 Grant et al.
3,479,731 A 11/1969 Mantel et al.
(Continued)

FOREIGN PATENT DOCUMENTS

JP S52-29656 U 3/1977
JP S58-100992 A 6/1983
(Continued)

OTHER PUBLICATIONS

Written Opinion of the International Searching Authority issued in International Application No. PCT/JP2016/080159, dated Dec. 6, 2016.
(Continued)

*Primary Examiner* — Devon Russell
(74) *Attorney, Agent, or Firm* — Arent Fox LLP

(57) ABSTRACT

A heat pipe that includes a pipe casing, a porous wick, and sealing members. Both end portions of the pipe casing are sealed by the sealing members, respectively. The sealing members each comprise a first metal foil and an intermetallic compound phase. The inside of the pipe casing is filled with a working fluid. The porous wick generates capillarity for the working fluid by a plurality of pores. The porous wick is provided inside the pipe casing. As a result, the pipe casing and the porous wick form a cavity extending in a longitudinal direction of the pipe casing. The porous wick comprises first metal grains, second metal grains, and an intermetallic compound phase.

17 Claims, 30 Drawing Sheets

(51) Int. Cl.

| | |
|---|---|
| ***F28D 15/02*** | (2006.01) |
| ***F28F 19/00*** | (2006.01) |
| ***F28F 21/08*** | (2006.01) |
| *F28D 21/00* | (2006.01) |

(52) U.S. Cl.
CPC ..... *F28F 19/00* (2013.01); *F28F 21/081* (2013.01); *F28F 21/085* (2013.01); *F28D 2021/0028* (2013.01)

(56) References Cited

U.S. PATENT DOCUMENTS

| | | | | |
|---|---|---|---|---|
| 4,398,975 | A | 8/1983 | Ohsawa et al. | |
| 5,597,656 | A | 1/1997 | Carey et al. | |
| 5,965,197 | A | 10/1999 | Jin et al. | |
| 6,186,390 | B1 | 2/2001 | Tadauchi et al. | |
| 6,738,257 | B1 * | 5/2004 | Lai | F28D 15/0266 165/104.26 |
| 7,516,548 | B2 | 4/2009 | Twigg | |
| 8,152,953 | B2 | 4/2012 | Yoshimura et al. | |
| 8,563,872 | B2 | 10/2013 | Hirai et al. | |
| 9,105,987 | B2 | 8/2015 | Nakano et al. | |
| 2003/0196732 | A1 | 10/2003 | Carey et al. | |
| 2004/0134966 | A1 | 7/2004 | Chang et al. | |
| 2004/0211291 | A1 | 10/2004 | Ono et al. | |
| 2005/0022975 | A1 | 2/2005 | Rosenfeld et al. | |
| 2005/0022984 | A1 * | 2/2005 | Rosenfeld | B22F 3/1103 165/260 |
| 2005/0098609 | A1 | 5/2005 | Greenhut et al. | |
| 2006/0061974 | A1 | 3/2006 | Soga et al. | |
| 2006/0180296 | A1 * | 8/2006 | Liu | B22F 5/106 165/104.26 |
| 2007/0240854 | A1 * | 10/2007 | Liu | F28D 15/046 165/104.26 |
| 2007/0277961 | A1 * | 12/2007 | Yu | F28D 15/0283 165/104.19 |
| 2008/0012131 | A1 | 1/2008 | Tanaka | |
| 2008/0213614 | A1 | 9/2008 | Wieres et al. | |
| 2010/0197534 | A1 | 8/2010 | Yuasa | |
| 2011/0068149 | A1 | 3/2011 | Hirano et al. | |
| 2012/0156512 | A1 | 6/2012 | Nakano et al. | |
| 2013/0233618 | A1 | 9/2013 | Nakano et al. | |
| 2013/0270001 | A1 | 10/2013 | Nakano et al. | |
| 2013/0299236 | A1 | 11/2013 | Nakano et al. | |
| 2014/0174605 | A1 | 6/2014 | Nakagawa et al. | |
| 2014/0174706 | A1 | 6/2014 | Yamada et al. | |
| 2014/0178703 | A1 * | 6/2014 | Nakano | C22C 13/00 428/457 |
| 2014/0193650 | A1 * | 7/2014 | Nakano | C22C 9/00 428/457 |
| 2014/0345939 | A1 * | 11/2014 | Nakano | C22C 9/04 174/94 R |
| 2014/0356055 | A1 * | 12/2014 | Nakano | C22C 9/00 403/271 |
| 2014/0363221 | A1 | 12/2014 | Nakano | |
| 2015/0034701 | A1 | 2/2015 | Takaoka | |
| 2015/0072165 | A1 | 3/2015 | Sunaga | |
| 2015/0204617 | A1 | 7/2015 | Thanhlong et al. | |
| 2016/0031027 | A1 | 2/2016 | Chu et al. | |
| 2016/0240505 | A1 | 8/2016 | Tatsumi et al. | |
| 2016/0288245 | A1 * | 10/2016 | Ishino | B23K 35/302 |
| 2016/0297029 | A1 | 10/2016 | Ishino et al. | |
| 2016/0338201 | A1 | 11/2016 | Kiyono et al. | |
| 2017/0252872 | A1 | 9/2017 | Hartmann | |
| 2018/0092258 | A1 | 3/2018 | Beers et al. | |

FOREIGN PATENT DOCUMENTS

| | | | |
|---|---|---|---|
| JP | S63-183772 | A | 7/1988 |
| JP | H03-110392 | A | 5/1991 |
| JP | H06-47579 | A | 2/1994 |
| JP | H07-299591 | A | 11/1995 |
| JP | H09-119789 | A | 5/1997 |
| JP | 2001-205476 | A | 7/2001 |
| JP | 2002-301588 | A | 10/2002 |
| JP | 2004-174522 | A | 6/2004 |
| JP | 2005-52856 | A | 3/2005 |
| JP | 3110111 | U | 6/2005 |
| JP | 2009-106993 | A | 5/2009 |
| JP | 5018978 | B1 | 9/2012 |
| JP | 2013-212524 | A | 10/2013 |
| JP | 2014-180690 | A | 9/2014 |
| JP | 2015-42421 | A | 3/2015 |
| JP | 5685656 | B1 | 3/2015 |
| JP | 2015-93295 | A | 5/2015 |
| JP | 2015-135211 | A | 7/2015 |
| JP | 2015-147989 | A | 8/2015 |
| JP | 2015-166101 | A | 9/2015 |
| WO | WO 98/33621 | A1 | 8/1998 |
| WO | WO 2012/066795 | A1 | 5/2012 |
| WO | WO 2013/038816 | A1 | 3/2013 |
| WO | WO 2013/038817 | A1 | 3/2013 |
| WO | 2015105088 | A1 | 7/2015 |
| WO | WO 2015/105089 | A1 | 7/2015 |

OTHER PUBLICATIONS

International Search Report issued in International Application No. PCT/JP2016/073532, dated Nov. 8, 2016.

International Search Report issued in International Application No. PCT/JP2016/075615, dated Nov. 15, 2016.

International Search Report issued in International Application No. PCT/JP2016/080159, dated Dec. 6, 2016.

Written Opinion of the International Searching Authority issued in International Application No. PCT/JP2016/073532, dated Nov. 8, 2016.

Written Opinion of the International Searching Authority issued in International Application No. PCT/JP2016/075615, dated Nov. 15, 2016.

* cited by examiner

HEAT PIPE, HEAT DISSIPATING COMPONENT, AND METHOD FOR MANUFACTURING HEAT PIPE

CROSS REFERENCE TO RELATED APPLICATIONS

The present application is a continuation of International application No. PCT/JP2016/075615, filed Sep. 1, 2016, which claims priority to Japanese Patent Application No. 2015-189647, filed Sep. 28, 2015, and Japanese Patent Application No. 2016-064747, filed Mar. 28, 2016, the entire contents of each of which are incorporated herein by reference.

FIELD OF THE INVENTION

The present invention relates to a heat pipe, a heat dissipating component including the heat pipe, and a method for manufacturing the heat pipe.

BACKGROUND OF THE INVENTION

Conventionally, a heat pipe for cooling a heat generating body such as an electronic component has been known. For example, Patent Document 1 discloses a heat pipe including a pipe casing and a porous wick. Both end portions of the pipe casing in its longitudinal direction constitute a heating portion that is heated by coming into contact with a heat generating body and, for example, a cooling portion that is naturally cooled. The pipe casing is filled with a working fluid. The working fluid is constituted of a substance that undergoes phase transformation at a predetermined temperature. The working fluid is, for example, water, alcohols, or ammonia water.

The porous wick has a plurality of pores, and generates capillarity for the working fluid.

The porous wick is provided inside the pipe casing. As a result, the pipe casing and the porous wick form a cavity extending in the longitudinal direction of the pipe casing. The cavity communicates with the plurality of pores. The porous wick interconnects the heating portion and the cooling portion in the pipe casing. In general, a porous wick is constituted of a sintered body in which copper grains are sintered inside a pipe casing.

As described above, in the heat pipe of Patent Document 1, the working fluid is evaporated by heat of the heat generating body at the heating portion to become a gas. The gas passes through the cavity and moves to the cooling portion, and its heat is dissipated in the cooling portion to be liquefied. The liquefied working fluid permeates into the porous wick. Then, the working fluid is refluxed from the cooling portion toward the heating portion by the capillarity of the porous wick. Accordingly, the heat pipe of Patent Document 1 cools the heat generating body.

Patent Document 1: Japanese Patent No. 5685656

SUMMARY OF THE INVENTION

Unfortunately, in the heat pipe of Patent Document 1, the porous wick is formed by sintering copper grains inside the pipe casing. Thus, the pipe casing needs to be heated to a temperature slightly lower than the melting point (1084° C.) of the copper grains.

In addition, the pipe casing is generally sealed by welding or brazing. Thus, the pipe casing needs to be heated to a high temperature (e.g., 450° C. in the case of brazing).

Therefore, in the heat pipe of Patent Document 1, there is a problem that the pipe casing may deteriorate (oxidize or the like) at a high temperature.

It is an object of the present invention to provide a heat pipe that is capable of greatly suppressing deterioration of a pipe casing, a heat dissipating component, and a method for manufacturing a heat pipe.

A heat pipe of the present invention includes a pipe casing and a porous wick. The pipe casing is filled with a working fluid. The porous wick is provided inside the pipe casing. The porous wick includes an intermetallic compound formed from at least a first metal and a second metal having a melting point higher than a melting point of the first metal. The porous wick may be formed of a material containing the first metal, the second metal, and the intermetallic compound.

In this configuration, the second metal is at least one kind of alloy selected from the group consisting of a CuNi alloy, a CuMn alloy, a CuAl alloy, and a CuCr alloy, for example. The first metal is at least one kind of metal selected from the group consisting of Sn and a Sn-based alloy, for example. Sn has a melting point of 231.9° C.

In this configuration, at least the first metal and the second metal react with each other by being heated at a temperature equal to or higher than the melting point of the first metal, so that an intermetallic compound containing at least the first metal and the second metal is produced. The intermetallic compound produced in this reaction constitutes the porous wick. Thus, in the heat pipe with this configuration, it is possible to provide the porous wick inside the pipe casing at a temperature extremely lower than the above-mentioned sintering temperature.

Accordingly, the heat pipe with this configuration can suppress deterioration of the pipe casing.

In addition, the heat pipe of the present invention includes a pipe casing, a wick, and a sealing member. The pipe casing is filled with a working fluid. The wick is provided inside the pipe casing. The sealing member seals the pipe casing. For example, the sealing member seals an end portion of the pipe casing. The sealing member includes an intermetallic compound formed from at least a first metal and a second metal having a melting point higher than a melting point of the first metal. The sealing member may be formed of a material containing the first metal and the intermetallic compound.

In this configuration, the second metal is at least one kind of alloy selected from the group consisting of a CuNi alloy, a CuMn alloy, a CuAl alloy, and a CuCr alloy, for example. The first metal is at least one kind of metal selected from the group consisting of Sn and a Sn-based alloy, for example. Sn has a melting point of 231.9° C.

In this configuration, at least the first metal and the second metal react with each other by being heated at a temperature equal to or higher than the melting point of the first metal, so that an intermetallic compound containing at least the first metal and the second metal is produced. The intermetallic compound produced in this reaction constitutes the sealing member. Thus, in the heat pipe with this configuration, it is possible to provide the sealing member at a temperature extremely lower than the above-mentioned sintering temperature.

Accordingly, the heat pipe with this configuration can suppress deterioration of the pipe casing.

In addition, a heat dissipating component of the present invention includes the heat pipe of the present invention. Thus, the heat dissipating component of the present invention achieves an effect similar to the effect of the heat pipe of the present invention.

A method for manufacturing a heat pipe of an aspect of the present invention includes an installation step and a heating step. In the installation step, a metal composition is provided inside a pipe casing. The metal composition contains a first metal and a second metal having a melting point higher than a melting point of the first metal. It is preferable that the metal composition contains a flux. In the heating step, for example, the metal composition is heated to a temperature within a range of equal to or higher than the melting point of the first metal and equal to or lower than a melting point of the second metal, and a porous wick is formed inside the pipe casing. The porous wick is formed of a material containing an intermetallic compound produced by a reaction between the first metal and the second metal.

The metal composition is preferably in a paste state, and the installation step may be a step of coating the inside of the pipe casing with the metal composition.

The method for manufacturing the heat pipe of the present invention achieves an effect similar to the effect of the heat pipe of the present invention including the above-described porous wick.

A further method for manufacturing a heat pipe of a further aspect of the present invention includes an installation step and a heating step, and, in the installation step, a metal composition is provided at an end of a pipe casing. The metal composition contains a first metal and a second metal having a melting point higher than a melting point of the first metal. It is preferable that the metal composition contains a flux. In the heating step, for example, the metal composition is heated to a temperature within a range of equal to or higher than the melting point of the first metal and equal to or lower than a melting point of the second metal, and a sealing member is formed an the end portion of the pipe casing. The sealing member is formed of a material containing an intermetallic compound produced by a reaction between the first metal and the second metal.

The manufacturing method for the heat pipe of the present invention achieves an effect similar to the effect of the heat pipe of the present invention including the above-described sealing member.

The present invention can suppress deterioration of a pipe casing.

DETAILED DESCRIPTION OF PREFERRED EMBODIMENTS OF THE INVENTION

Hereinafter, a heat pipe 100 according to a first embodiment of the present invention will be described.

Figure 1:
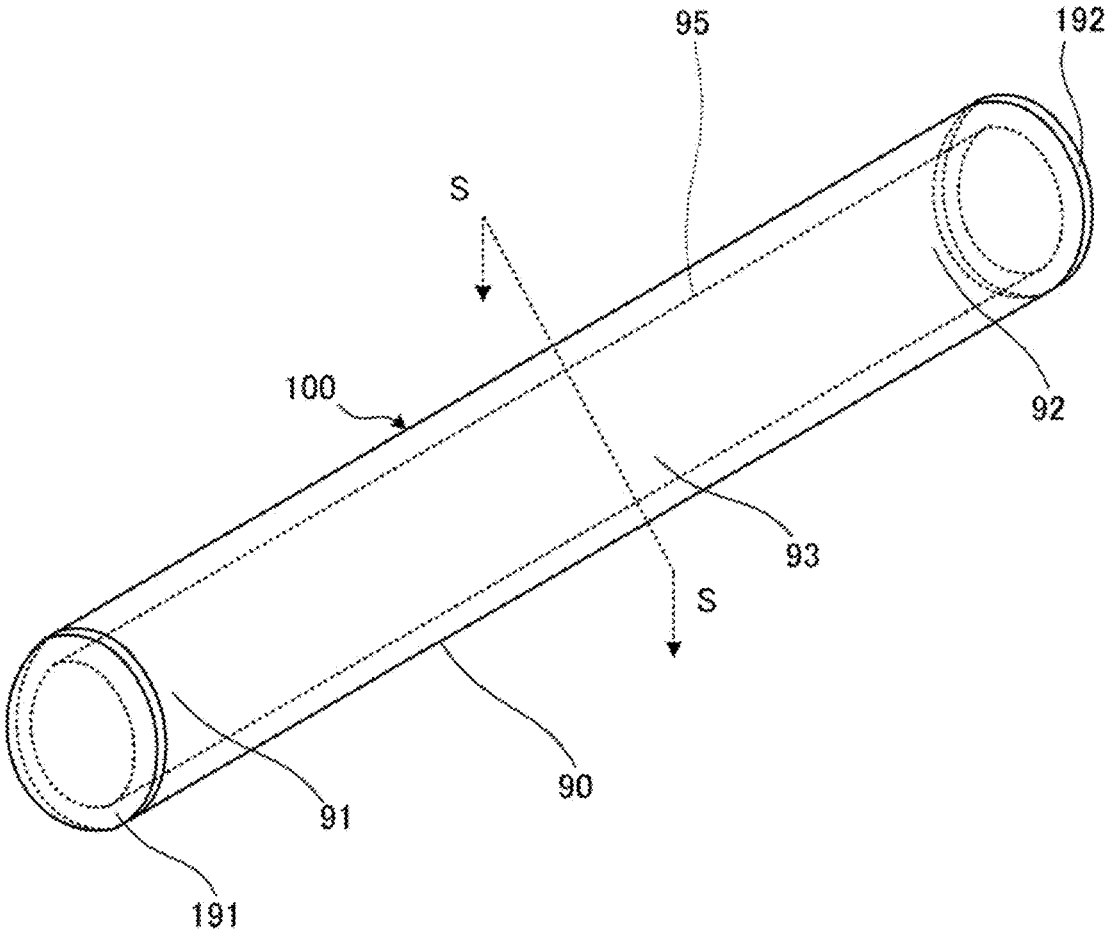
FIG. 1 is a perspective view illustrating an appearance of a heat pipe 100 according to a first embodiment of the present invention.
Figure 2:
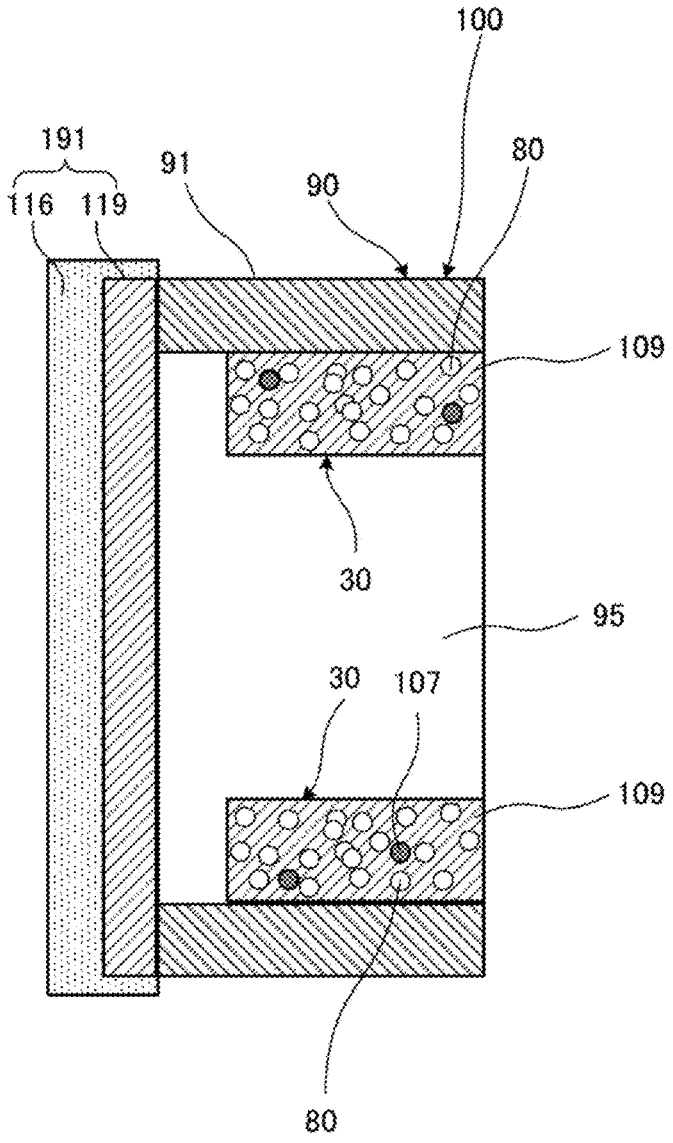
FIG. 2 is a cross-sectional view illustrating a first end portion 91 of the heat pipe 100 illustrated in FIG. 1.
Figure 3:
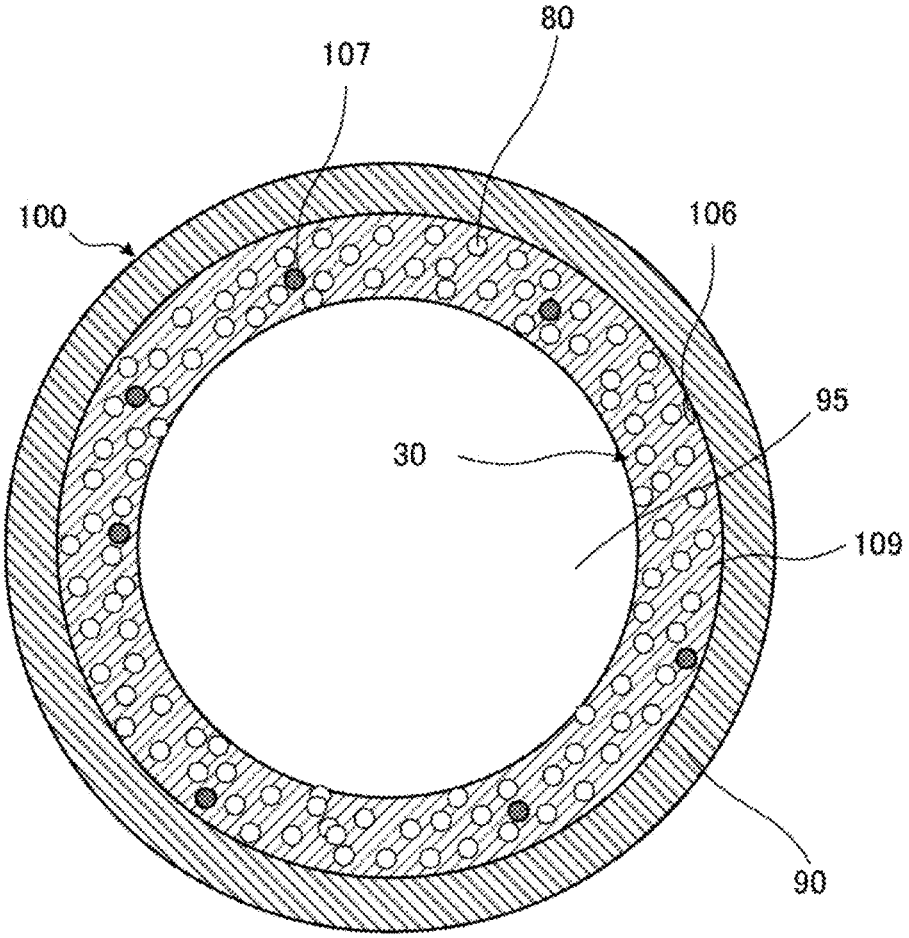
FIG. 3 is a cross-sectional view illustrating a central portion 93 of the heat pipe 100 illustrated in FIG. 1.

FIG. 1 is a perspective view illustrating an appearance of the heat pipe 100 according to the first embodiment of the present invention. FIG. 2 is a cross-sectional view illustrating a first end portion 91 of the heat pipe 100 illustrated in FIG. 1. FIG. 3 is a cross-sectional view illustrating a central portion 93 of the heat pipe 100 illustrated in FIG. 1. FIG. 3 is a cross-sectional view taken along line S-S illustrated in FIG. 1.

The heat pipe 100 includes a pipe casing 90, a porous wick 30, and sealing members 191 and 192. The heat pipe 100 is provided in a heat dissipating component to cool a heat generating body such as an electronic component. The heat dissipating component is a heat sink or a heat spreader, for example.

The pipe casing 90 has a cylindrical shape. The pipe casing 90 has both end portions 91 and 92 in a longitudinal direction of the pipe casing 90, and a central portion 93 positioned between the both end portions 91 and 92. A first end portion 91 of the pipe casing 90 constitutes a heating portion 91 that is heated by coming into contact with a heat generating body, and a second end portion 92 constitutes, for example, a cooling portion 92 that is naturally cooled. A material of the pipe casing 90 is Cu, for example.

The both end portions 91 and 92 of the pipe casing 90 are sealed by the sealing members 191 and 192, respectively. The sealing member 191 is constituted of a first metal foil 116 and an intermetallic compound phase 119. The sealing member 192 is also constituted of the first metal foil 116 and the intermetallic compound phase 119.

Regarding the heat pipe 100, the constitution of the second end portion 92 is the same as that of the first end portion 91, and the constitution of the sealing member 192 is the same as that of the sealing member 191. Thus, a description of the second end portion 92 and sealing member 192 of the pipe casing 90 will be omitted.

The inside of the pipe casing 90 is filled with a working fluid. The working fluid is constituted of a substance that undergoes phase transformation at a predetermined temperature. The working fluid is, for example, water, alcohols, or ammonia water.

The porous wick 30 has a plurality of pores 80 as illustrated in FIGS. 2 and 3. The plurality of pores 80 is basically open pores communicating with the outside of the porous wick 30. The porous wick 30 has a porosity of 20% to 70%, for example. The porous wick 30 generates capillarity for the working fluid by the plurality of pores 80.

The porous wick 30 has a cylindrical shape. The porous wick 30 is provided inside the pipe casing 90. The porous wick 30 extends in the longitudinal direction of the pipe casing 90 to interconnect the heating portion 91 and the cooling portion 92 in the pipe casing 90.

As a result, the pipe casing 90 and the porous wick 30 form a cavity 95 extending in the longitudinal direction of the pipe casing 90. The cavity 95 communicates with the plurality of pores 80. The porous wick 30 is constituted of first metal grains 106, second metal grains 107, and an intermetallic compound phase 109.

As described above, in the heat pipe 100, the working fluid is evaporated by heat of the heat generating body in the heating portion 91 to become a gas. The gas passes through the cavity 95 and moves to the cooling portion 92, and its heat is dissipated in the cooling portion 92 to be liquefied. The liquefied working fluid permeates into the plurality of pores 80 of the porous wick 30. Then, the working fluid is refluxed from the cooling portion 92 toward the heating portion 91 by the capillarity of the porous wick 30. As a result, the heat pipe 100 cools the heat generating body.

The pores 80 in FIGS. 2 and 3 are schematically illustrated. In the porous wick 30, there are also minute pores 80 and pores 80 at a grain interface level, which do not appear in FIGS. 2 and 3. Thus, the working fluid can move in the porous wick 30 through these pores 80 in the longitudinal direction of the pipe casing 90.

The intermetallic compound phase 109 and the intermetallic compound phase 119 are each a phase composed of an intermetallic compound. Differences between the intermetallic compound phase 109 and the intermetallic compound phase 119 will be described below. The intermetallic compound is formed from a first metal and a second metal. A material of the first metal is Sn or a Sn-based alloy. The Sn-based alloy is, for example, a SnAgCu alloy, a SnAg alloy, a SnCu alloy, a SnBi alloy, a SnSb alloy, a SnAu alloy, a SnPb alloy, or a SnZn alloy. The second metal is a metal that reacts with the melting first metal to produce the intermetallic compound. A material of the second metal is at least one kind selected from the group consisting of a CuNi alloy, a CuMn alloy, a CuAl alloy, and a CuCr alloy. A material of the intermetallic compound is, for example, $(Cu,Ni)_6Sn_5$, $Cu_4Ni_2Sn_5$, $Cu_5NiSn_5$, $(Cu,Ni)_3Sn$, $CuNi_2Sn$, or $Cu_2NiSn$.

The second metal has a melting point higher than a melting point of the first metal. The intermetallic compound has a melting point higher than the melting point of the first metal. The intermetallic compound has a melting point of 400° C. or higher, for example. When the material of each of the first metal grains 106 is Sn, the first metal grain 106 has a melting point of 231.9° C. The first metal grains 106 and the second metal grains 107 illustrated in FIG. 3 remain without reacting in a heating step to be described below.

In the heat pipe 100, the melted first metal and second metal react with each other by being heated at a temperature equal to or higher than the melting point of the first metal, so that an intermetallic compound composed of the first metal and the second metal is produced. The intermetallic compound phase 109 formed by this reaction constitutes the porous wick 30. In addition, the intermetallic compound phase 119 formed by this reaction constitutes the sealing members 191 and 192.

Thus, in the heat pipe 100, the porous wick 30 can be provided inside the pipe casing 90 at a temperature extremely lower than the above-mentioned sintering temperature. Similarly, in the heat pipe 100, the both end portions 91 and 92 of the pipe casing 90 can be provided with the sealing members 191 and 192, respectively, at a temperature extremely lower than the above-described sintering temperature.

As a result, the heat pipe 100 and a heat dissipating component including the heat pipe 100 can suppress deterioration of the pipe casing 90.

In addition, the intermetallic compound phase 109 has a high melting point (e.g., 400° C. or higher). Thus, the porous wick 30 constituted of the intermetallic compound phase 109 has high heat resistance. The intermetallic compound phase 119 also has a high melting point (e.g., 400° C. or higher). Thus, the sealing members 191 and 192 each constituted of the intermetallic compound phase 119 have high heat resistance.

In particular, the intermetallic compound has a melting point higher than that of the first metal, so that even when the heat pipe 100 is further mounted on other device, component, substrate, or the like by being heated during reflow, for example, the structure of the porous wick 30 as well as the structures of the sealing members 191 and 192 are not impaired, and functions of the heat pipe 100 can be maintained.

The heat pipe 100 shown above can be manufactured, for example, by the following manufacturing method.

Figure 4:
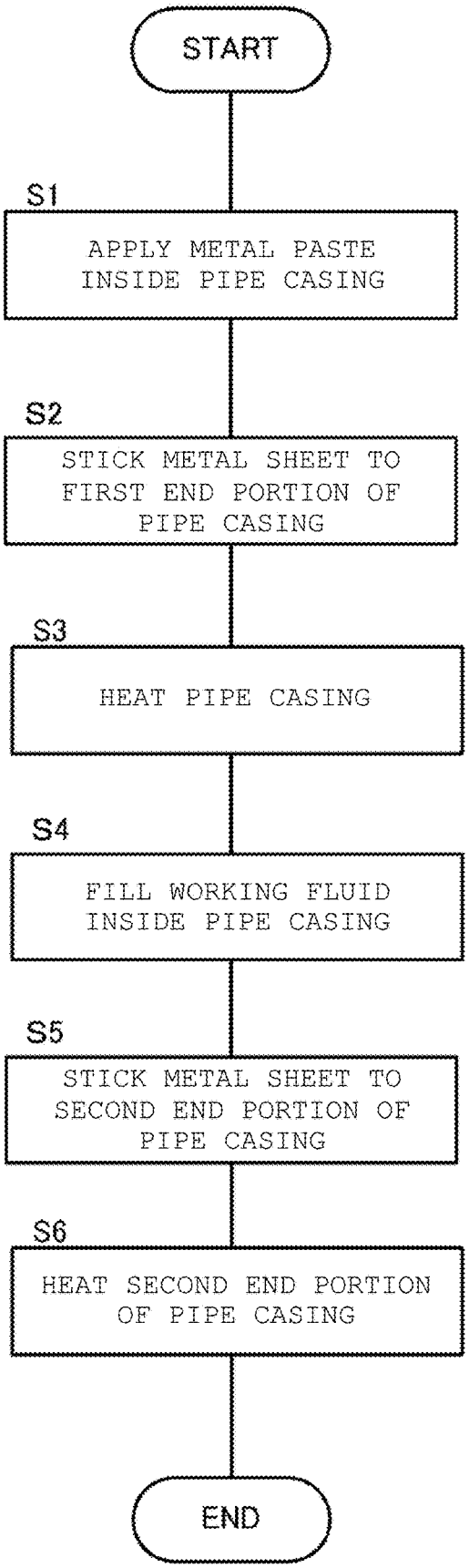
FIG. 4 is a flowchart illustrating a method for manufacturing the heat pipe 100 illustrated in FIG. 1.
Figure 5:
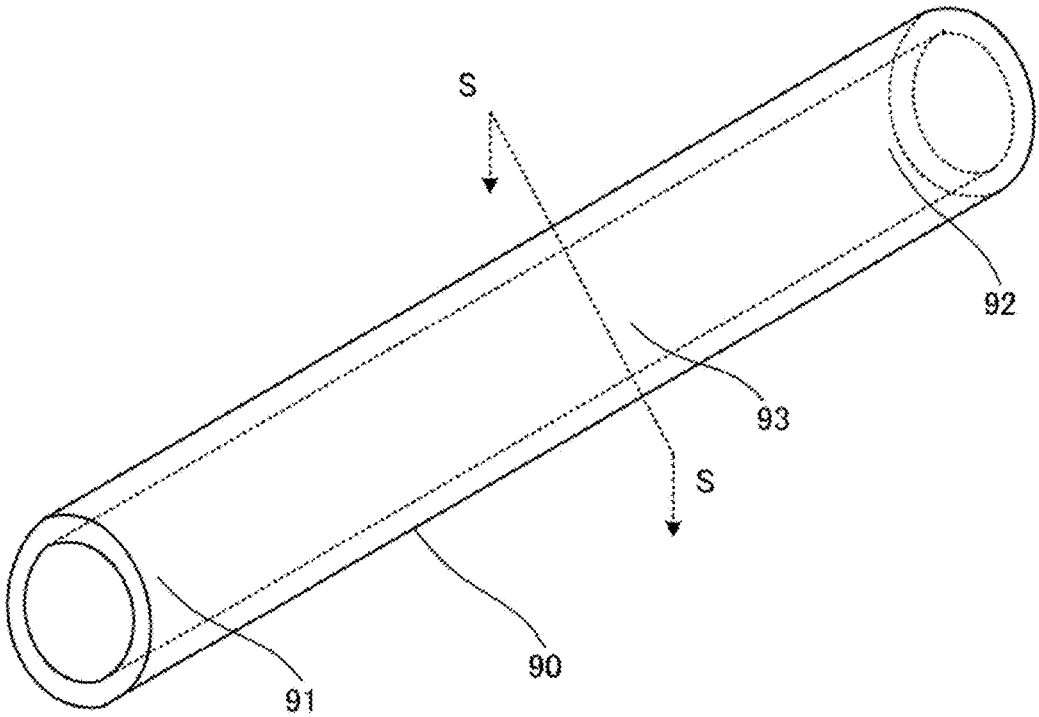
FIG. 5 is a perspective view illustrating an appearance of a pipe casing 90 prepared in the method for manufacturing the heat pipe 100 illustrated in FIG. 4.
Figure 5:
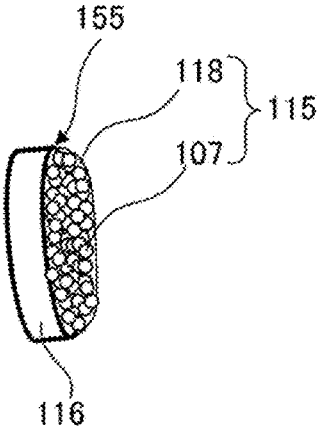
Figure 6A:
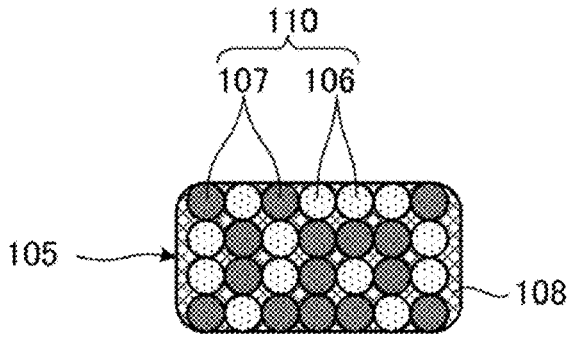
FIG. 6(A) is a cross-sectional view of a metal paste 105 prepared in the method for manufacturing the heat pipe 100 illustrated in FIG. 4.

FIG. 4 is a flowchart illustrating a method for manufacturing the heat pipe 100 illustrated in FIG. 1. FIG. 5 is a perspective view illustrating an appearance of a pipe casing 90 prepared in the method for manufacturing the heat pipe 100 illustrated in FIG. 4. FIG. 6(A) is a cross-sectional view of a metal paste 105 prepared in the method for manufacturing the heat pipe 100 illustrated in FIG. 4.

Figure 6B:
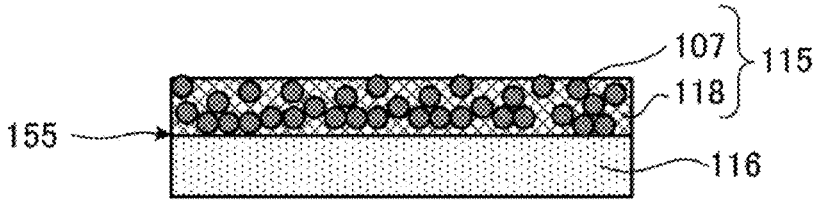
FIG. 6(B) is a cross-sectional view of a metal sheet 155 prepared in the method for manufacturing the heat pipe 100 illustrated in FIG. 4.
Figure 7:
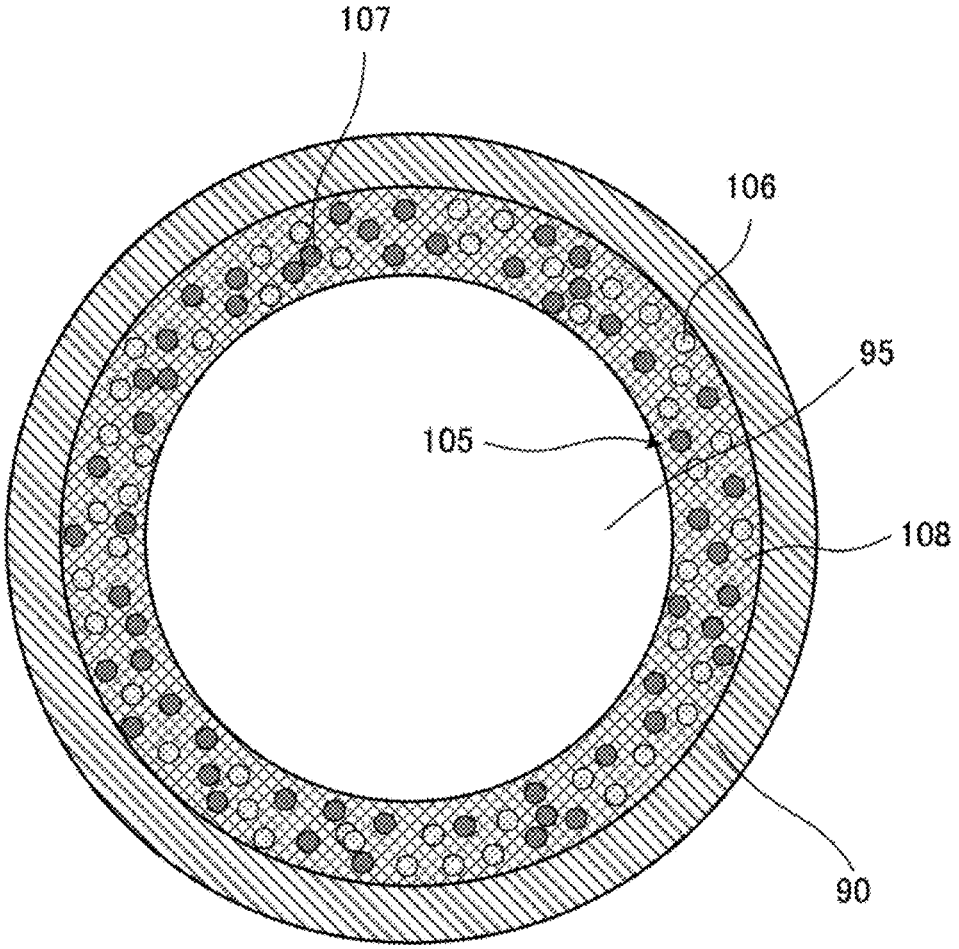
FIG. 7 is a cross-sectional view illustrating a state of a coating step illustrated in FIG. 4.
Figure 8:
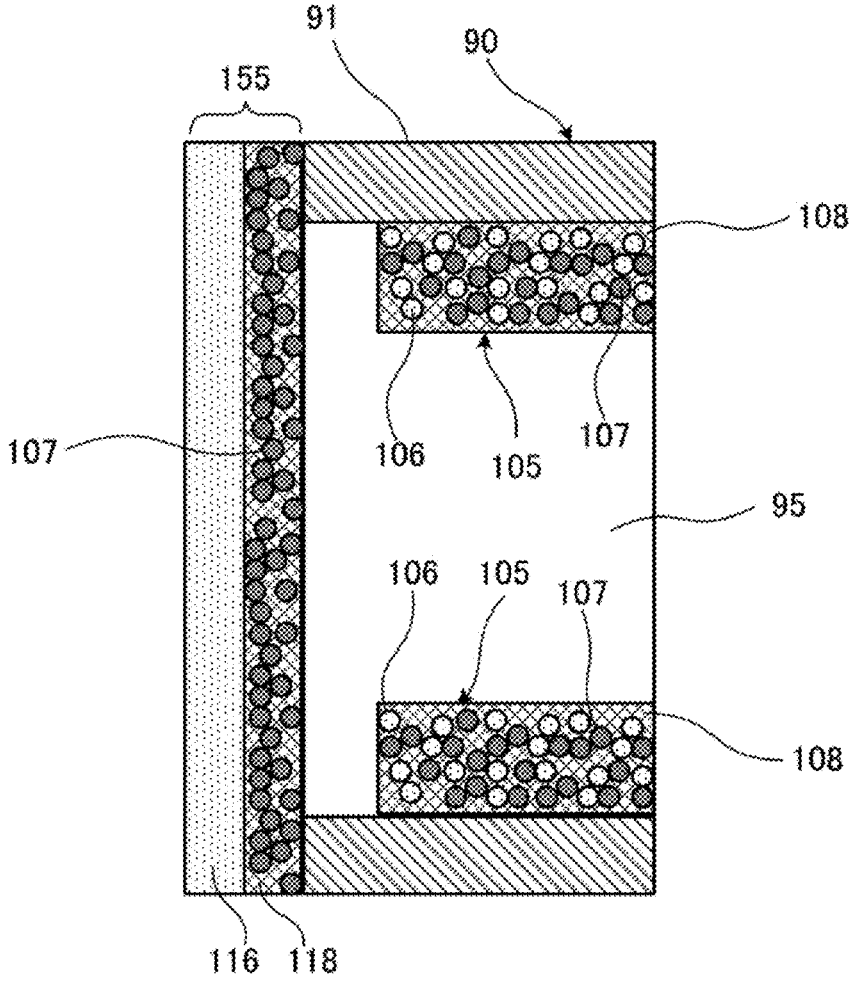
FIG. 8 is a cross-sectional view illustrating a state of a sticking step illustrated in FIG. 4.
Figure 9:
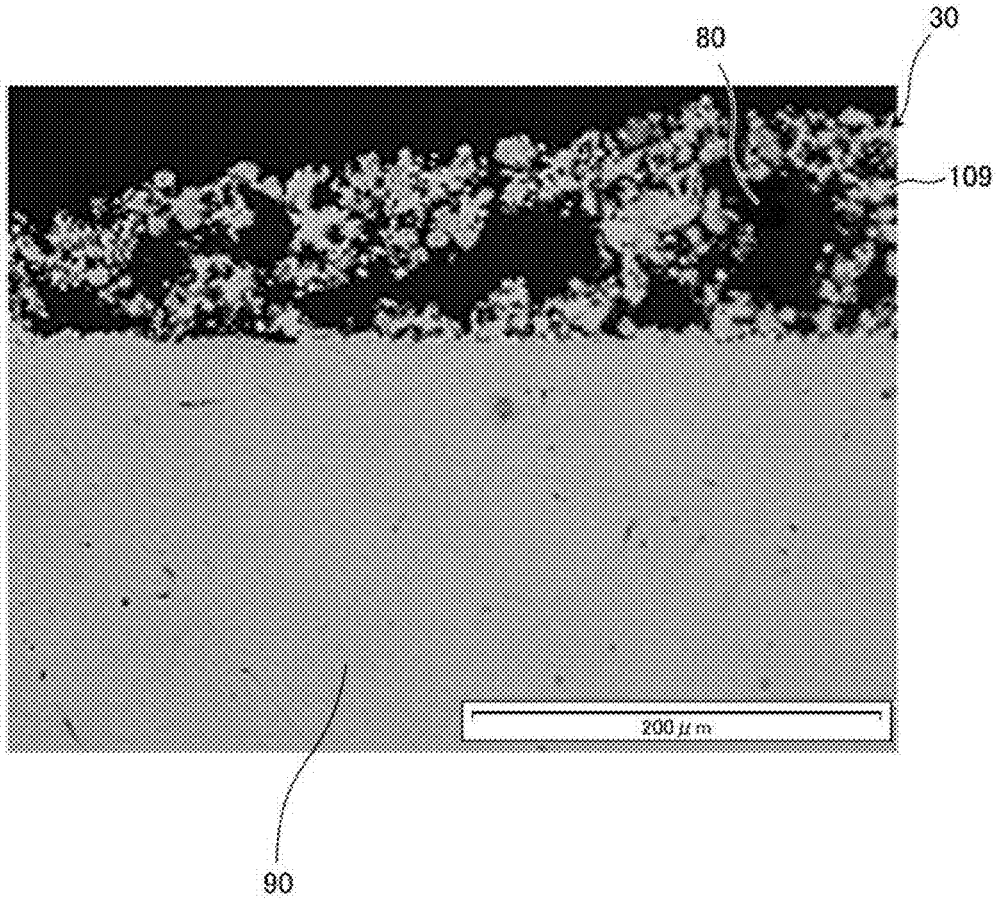
FIG. 9 is an enlarged cross-sectional view illustrating a state of an intermetallic compound phase 109 formed from the metal paste 105 in the heating step illustrated in FIG. 4.
Figure 10:
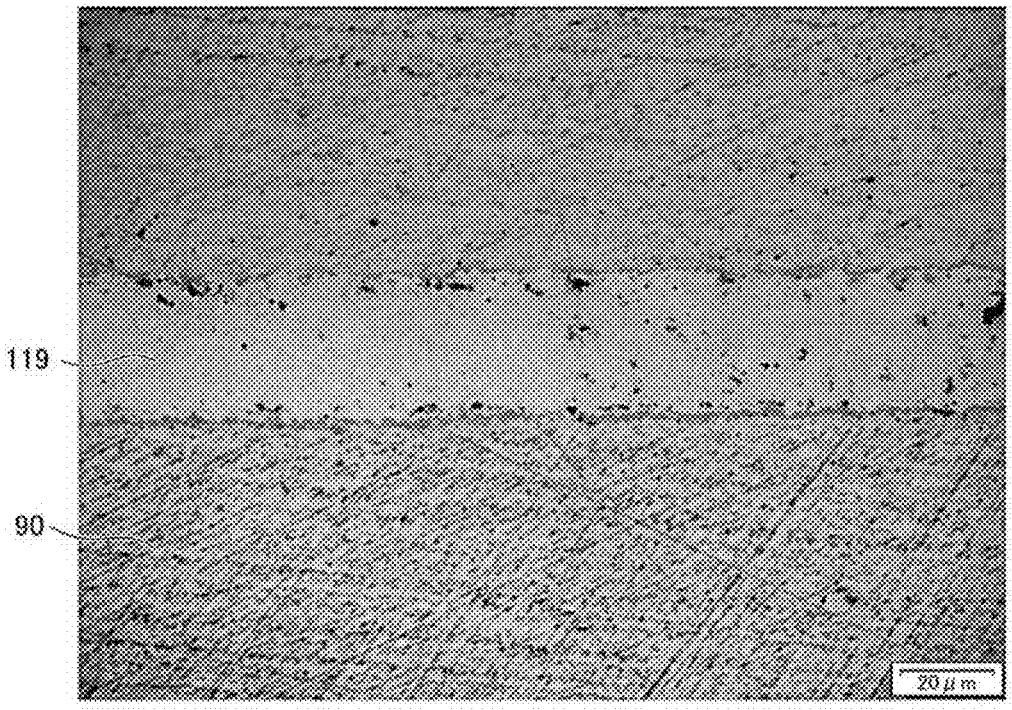
FIG. 10 is an enlarged cross-sectional view illustrating a state of an intermetallic compound phase 119 formed from the metal sheet 155 in the heating step illustrated in FIG. 4.

FIG. 6(B) is a cross-sectional view of a metal sheet 155 prepared in the method for manufacturing the heat pipe 100 illustrated in FIG. 4. FIG. 7 is a cross-sectional view illustrating a state of a coating step illustrated in FIG. 4. FIG. 8 is a cross-sectional view illustrating a state of a sticking step illustrated in FIG. 4. FIG. 9 is an enlarged cross-sectional view illustrating a state of an intermetallic compound phase 109 formed from the metal paste 105 in the heating step illustrated in FIG. 4. FIG. 10 is an enlarged cross-sectional view illustrating a state of an intermetallic compound phase 119 formed from the metal sheet 155 in the heating step illustrated in FIG. 4.

First, as illustrated in FIGS. 5, 6(A), and 6(B), a pipe casing 90, a metal paste 105, and a metal sheet 155 are prepared. Each of the metal paste 105 and the metal sheet 155 corresponds to an example of the metal composition of the present invention.

As illustrated in FIG. 6(A), the metal paste 105 contains a metal component 110 and an organic component 108. The metal component 110 is composed of the first metal grains 106 and the second metal grains 107. The first metal grains 106 and the second metal grains 107 are uniformly dispersed in the organic component 108.

As illustrated in FIG. 6(B), the metal sheet 155 includes a coating film 115 and a first metal foil 116. The coating film 115 contains the second metal grains 107 as a metal component uniformly dispersed in the organic component 118.

In the method for manufacturing the heat pipe 100, Sn is used for the material of the first metal grains 106, and a CuNi alloy is used for the material of the second metal grains 107. The CuNi alloy reacts with melted Sn to produce a CuNiSn alloy serving as an intermetallic compound.

It is preferable that the first metal grains 106 have an average grain diameter (D50) within a range of 1 to 100 μm. In addition, it is preferable that the second metal grains 107 have an average grain diameter (D50) within a range of 0.1 to 30 μm. In particular, the average grain diameter of the second metal grains 107 greatly affects the amount of the intermetallic compound to be produced. The average grain diameter (D50) means a grain size at an integrated value of 50% in the grain size distribution obtained by a laser diffraction/scattering method, for example.

When the average grain diameter of the first metal grains 106 is less than 1 μm, the surface area of the Sn grains increases. This causes more oxides to be formed on the surfaces of the Sn grains, so that wettability of the Sn grains to the second metal grains 107 decreases to cause a tendency of suppressing the reaction to produce the intermetallic compound. Meanwhile, when the average grain diameter of the first metal grains 106 is more than 100 μm, the amount of Sn becomes excessive, and thus a porosity of the porous wick 30 may remarkably decrease.

When the average grain diameter of the second metal grains 107 is less than 0.1 μm, the surface area of the CuNi alloy grains increases. This causes more oxides to be formed on the surfaces of the CuNi alloy grains, so that wettability of the CuNi alloy grains to the melted Sn decreases to cause a tendency of inhibiting the reaction to produce the intermetallic compound.

Meanwhile, when the average grain diameter of the second metal grains 107 is more than 30 μm, a gap size between the CuNi alloy grains increases. Accordingly, it is not possible to use the CuNi alloy grains up to their central portion for the reaction to produce the intermetallic compound, so that the CuNi alloy to be used for the production reaction lacks. As a result, the amount of the intermetallic compound to be produced decreases.

In the metal paste 105, it is preferable that the compounding ratio of the second metal grains 107 to the first metal grains 106 is within the range of 50:50 to 20:80 by weight.

In addition, in the metal paste 105 and coating film 115 of the metal sheet 155, it is preferable that the compounding ratio of the metal component to the organic component is within the range of 75:25 to 99.5:0.5 by weight. When the amount of the metal component to be compounded is more than the above-mentioned amount, sufficient viscosity cannot be obtained, and thus the metal component may fall off from the organic component. Meanwhile, when the amount of the metal component to be compounded is less than the above-mentioned amount, the first metal cannot be sufficiently reacted, and thus a large amount of unreacted first metal grains 106 may remain in the intermetallic compound phase 109 or the intermetallic compound phase 119.

Next, the organic component 108 includes a flux, a solvent, a thixotropic agent, or the like. The organic component 108 has a viscosity lower than a viscosity of the organic component 118. Other constitution of the organic component 118 is the same as the constitution of the organic component 108, so that a description of the organic component 118 will be omitted.

The flux includes a rosin and an activator. The flux achieves a reducing function of removing an oxide film on each of surfaces of the pipe casing 90, the first metal grains 106, and the second metal grains 107.

The rosin may be, for example, natural rosin, rosin derivatives such as hydrogenated rosin, disproportionated rosin, polymerized rosin, unsaturated dibasic acid modified rosin, and acrylic acid modified rosin, or a mixture thereof. For example, polymerized rosin R-95 is used as the rosin.

The activator promotes a reduction reaction of the flux. The activator may be, for example, monocarboxylic acids (e.g., formic acid, acetic acid, lauric acid, palmitic acid, stearic acid, benzoic acid, etc.), dicarboxylic acids (e.g., oxalic acid, malonic acid, succinic acid, glutaric acid, adipic acid, suberic acid, azelaic acid, sebacic acid, phthalic acid, etc.), bromoalcohols (e.g., 1-bromo-2-butanol, etc.), hydrohalogenic acid salts of organic amines, bromoalkanes, bromoalkenes, benzyl bromides, polyamines, or a chlorine-based activator. For example, adipic acid is used as the activator.

The solvent adjusts the viscosity of the metal paste 105. Similarly, the solvent adjusts the viscosity of the coating film 115 of the metal sheet 155. The solvent may be, for example, alcohol, ketone, ester, ether, aromatics, or hydrocarbons. For example, hexyl diglycol (HeDG) is used as the solvent.

The thixotropic agent maintains the metal component and the organic component so as not to be separated after they are uniformly mixed. The thixotropic agent may be, for example, hydrogenated castor oil, carnauba wax, amides, hydroxy fatty acids, dibenzylidene sorbitol, bis(p-methylbenzylidene) sorbitols, beeswax, stearic acid amide, or hydroxystearic acid ethylene bisamide.

The metal paste 105 and the metal sheet 155 may each contain the following as additives: Ag, Au, Al, Bi, C, Co, Cu, Fe, Ga, Ge, In, Mn, Mo, Ni, P, Pb, Pd, Pt, Si, Sb, or Zn, or the like. In addition, the metal paste 105 and the metal sheet 155 may each contain not only the additive described above but also a metal complex, a metal compound, or the like as an additive.

Next, as illustrated in FIG. 7, the metal paste 105 is applied to an inner surface of the pipe casing 90 so as to have a uniform thickness (S1: coating step). That is, in this coating step, the metal paste 105 is provided on the inner surface of the pipe casing 90 so as to have a uniform thickness. As a specific coating method, the metal paste 105 can be applied to the inner surface of the pipe 90 by, for example, pressure-feeding the metal paste 105 to the pipe casing 90 with compressed air.

Subsequently, in order to seal the first end portion 91 of the pipe casing 90 with the sealing member 191 as illustrated in FIGS. 1 and 2, the metal sheet 155 is stuck to the first end portion 91 of the pipe casing 90 (S2: sticking step) as illustrated in FIG. 8. That is, in this sticking step, the metal sheet 155 is provided at the first end portion 91 of the pipe casing 90.

Subsequently, the pipe casing 90 is heated using, for example, a reflow device (S3: heating step). In the heating step, the metal paste 105 and the metal sheet 155 are each heated to a temperature within the range of equal to or higher than the melting point of Sn and equal to or lower than the melting point of the CuNi alloy. Sn has a melting point of 231.9° C. The melting point of the CuNi alloy varies in accordance with the content of Ni, and is from 1220° C. to 1300° C., for example. For example, in the heating step, the pipe casing 90 is preheated at 150° C. to 230° C., and then heated at a heating temperature of 250° C. to 400° C. for two minutes to ten minutes. The peak temperature reaches 400° C.

When the temperature of the metal paste 105 reaches equal to or higher than the melting point of Sn by being heated, the first metal grains 106 melt. The reaction between the melted Sn and the second metal grains 107 generates, for example, the intermetallic compound phase 109 as illustrated in FIG. 9. This reaction is, for example, a reaction accompanying transient liquid phase diffusion bonding ("TLP bonding")

Similarly, when the temperature of the metal sheet 155 reaches equal to or higher than the melting point of Sn by being heated, the first metal foil 116 melt. The reaction between the melted Sn and the second metal grains 107 generates, for example, the intermetallic compound phase 119 as illustrated in FIG. 10. This reaction is, for example, a reaction accompanying transient liquid phase diffusion bonding ("TLP bonding")

The solvent contained in the organic components 108 and 118 volatilizes or evaporates during a period from the start of heating in the heating step to the completion of preheating.

After the reflow device stops heating, the reaction between the melted Sn and the second metal grains 107 is completed. As a result, the porous wick 30 and the sealing member 191 as illustrated in FIGS. 2, 3, 9, and 10 are obtained. After the reflow device stops heating, the porous wick 30 and the sealing member 191 naturally cool to room temperature.

As illustrated in FIG. 3, some of the first metal grains 106 and some of the second metal grains 107 do not react with each other and remain in the porous wick 30. For this reason, the porous wick 30 is constituted of the first metal grains 106, the second metal grains 107, and the intermetallic compound phase 109.

In addition, a part of the first metal foil 116 also remains without reacting as illustrated in FIG. 2. Excess Sn flows to an outer periphery of the intermetallic compound phase 119 as illustrated in FIG. 2 so as to cover the intermetallic compound phase 119. That is, the excess Sn seals the pipe casing 90 more reliably.

Subsequently, a working fluid is filled inside the pipe casing 90 (S4: filling step).

Next, as with the sticking step S2 illustrated in FIG. 8, the metal sheet 155 is stuck to the second end portion 92 of the pipe casing 90 (S5: sticking step). That is, in this sticking step, the metal sheet 155 is provided at the second end portion 92 of the pipe casing 90.

Subsequently, as with the heating step S3, the second end portion 92 of the pipe casing 90 is heated using, for example, a reflow device (S6: heating step). In the heating step, the metal sheet 155 stuck to the second end portion 92 of the pipe casing 90 is heated up to a temperature within the range of equal to or higher than the melting point of Sn and equal to or lower than the melting point of the CuNi alloy.

Here, Sn has a melting point of 231.9° C. The melting point of the CuNi alloy varies in accordance with the content of Ni, and is from 1220° C. to 1300° C., for example. Thus, for example, in the heating step, the second end portion 92 of the pipe casing 90 is preheated at 150° C. to 230° C., and then heated at a heating temperature of 250° C. to 400° C. for two minutes to five minutes. The peak temperature reaches 400° C.

When the temperature of the metal sheet 155 reaches equal to or higher than the melting point of Sn by being heated, the first metal foil 116 melts. The reaction between the melted Sn and the second metal grains 107 generates, for example, the intermetallic compound phase 119 as illustrated in FIG. 10. This reaction is, for example, a reaction accompanying transient liquid phase diffusion bonding ("TLP bonding")

The solvent contained in the organic component 118 volatilizes or evaporates during a period from the start of heating in the heating step to the completion of preheating.

After the reflow device stops heating, the reaction between the melted Sn and the second metal grains 107 is completed. As a result, as with the sealing member 191 illustrated in FIG. 2, the sealing member 192 is obtained. After the reflow device stops heating, the sealing member 192 naturally cools to normal temperature.

A part of the first metal foil 116 in the sealing member 192 remains without reacting, as with the sealing member 191 illustrated in FIG. 2. Excess Sn flows to an outer periphery of the intermetallic compound phase 119 so as to cover the intermetallic compound phase 119, as with the sealing member 191 illustrated in FIG. 2. That is, the excess Sn seals the pipe casing 90 more reliably.

The heat pipe 100 is obtained by the above manufacturing method. As a result of actually manufacturing the heat pipe 100 by the above manufacturing method, the following porous wick 30 and the sealing members 191 and 192 were obtained. The porous wick 30 has a porosity of 60% (refer to FIG. 9). The porous wick 30 has a pore diameter of 1 μm or more and 60 μm or less. The porous wick 30 has a heat conductivity of 21 to 23 (W/m·K), for example. Meanwhile, the sealing members 191 and 192 each have a porosity of 2% or less (refer to FIG. 10). In the present embodiment, the porosity is represented by a volume of pores per unit volume ($cm^3$).

In the above manufacturing method, the second metal reacts with the first metal to produce an intermetallic compound. The second metal is a CuNi alloy. The first metal is Sn. Sn has a melting point of 231.9° C.

In the above manufacturing method, the melted first metal and second metal react with each other by being heated at a temperature equal to or higher than the melting point of the first metal, so that an intermetallic compound composed of the first metal and the second metal is produced. The intermetallic compound phase 109 formed by this reaction constitutes the porous wick 30. Similarly, the intermetallic compound phase 119 formed by this reaction constitutes the sealing members 191 and 192.

Thus, it is possible to form the porous wick 30 inside the pipe casing 90 at a temperature extremely lower than the above-mentioned sintering temperature by the method for manufacturing the heat pipe 100. Similarly, it is possible to form the sealing members 191 and 192 at the both end portions 91 and 92 of the pipe casing 90, respectively, at a temperature extremely lower than the above-described sintering temperature by the method for manufacturing the heat pipe 100.

Accordingly, the method for manufacturing the heat pipe 100 can suppress deterioration of the pipe casing 90.

In addition, the intermetallic compound phase 109 has a high melting point (e.g., 400° C. or higher). Thus, the porous wick 30 produced by the above manufacturing method has high heat resistance. In addition, the intermetallic compound phase 119 has a high melting point (e.g., 400° C. or higher). Thus, the sealing members 191 and 192 produced by the above manufacturing method have high heat resistance.

In particular, the intermetallic compound has a melting point higher than that of the first metal, so that even when the heat pipe 100 is further mounted on other device, component, substrate, or the like by being heated during reflow, for example, the structure of the porous wick 30 as well as the structures of the sealing members 191 and 192 are not impaired, and functions of the heat pipe 100 can be maintained.

In addition, the intermetallic compound phase 119 of each of the sealing members 191 and 192 has a dense structure with an extremely low porosity as described above (refer to FIG. 10). Thus, the heat pipe 100 can reliably prevent leakage of the working fluid sealed in the pipe casing 90. The sealing members 191 and 192 are also excellent in impact resistance.

The method for manufacturing the heat pipe 100 can provide the porous wick 30 having a uniform thickness on the inner surface of the pipe casing 90 with simple application of the metal paste 105 to the inner surface of the pipe casing 90 in a uniform thickness manner even if the inner surface of the pipe casing 90 is curved.

In addition, it is possible to form the porous wick 30 with a high porosity inside the pipe casing 90 as described above by the method for manufacturing the heat pipe 100 (refer to FIG. 9). For this reason, the heat pipe 100 can have high liquid permeability and high capillarity. That is, the heat pipe 100 can have high thermal conductivity.

In the method for manufacturing the heat pipe 100, it is possible to adjust the porosity of each of the porous wick 30, the sealing members 191 and 192 to the range of equal to or more than 1% and equal to or less than 80% by adjusting the content, heating temperature and the like of materials used for the metal paste 105 and the metal sheet 155.

When porosity of the porous wick 30 is set to 20% or more, it is possible to improve the heat dissipation characteristics of the heat pipe 100 by the method for manufacturing the heat pipe 100. In particular, in the method for manufacturing the heat pipe 100, it is possible to set the porosity of the porous wick 30 to 45% or more, and thus a porosity that cannot be achieved by the sintered body can be realized.

In the method for manufacturing the heat pipe 100, it is possible to adjust the pore diameter of the porous wick 30 to the range of equal to or more than 1 μm and equal to or less than 100 μm by adjusting the content, heating temperature and the like of materials used for the metal paste 105 and the metal sheet 155. It is preferable that the pore diameter of the porous wick 30 is small as much as possible from the viewpoint of transportability due to capillarity. For example, in the method for manufacturing the heat pipe 100, it is possible to set the pore diameter of the porous wick 30 to the range of equal to or more than 5 μm and equal to or less than 40 μm, or the range of equal to or more than 10 μm and equal to or less than 30 μm, in accordance with conditions such as the length and inclination of the pipe casing 90, and the specific gravity of the working fluid.

Hereinafter, a heat pipe 200 according to a second embodiment of the present invention will be described.

Figure 11:
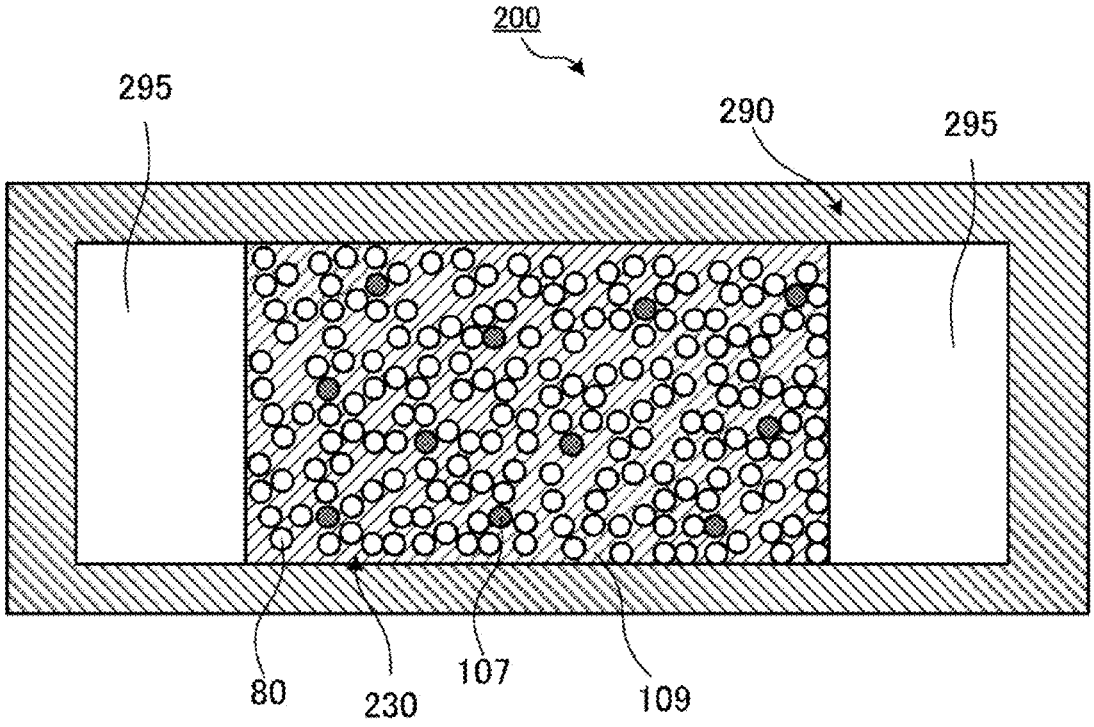
FIG. 11 is a cross-sectional view illustrating a central portion of a heat pipe 200 according to a second embodiment of the present invention.

FIG. 11 is a cross-sectional view illustrating a central portion of the heat pipe 200 according to the second embodiment of the present invention. The heat pipe 200 is different from the heat pipe 100 in the shapes of a pipe casing 290 and a porous wick 230. While the pipe casing 90 has a cylindrical shape, the pipe casing 290 has a rectangular cylindrical shape. While the porous wick 30 has a cylindrical shape, the porous wick 230 has a rectangular parallelepiped shape.

As with the porous wick 30 illustrated in FIGS. 1 and 2, the porous wick 230 extends in the longitudinal direction of the pipe casing 290 to interconnect a heating portion 91 and a cooling portion 92 in the pipe casing 290. Then, the pipe casing 290 and the porous wick 230 form a cavity 295 extending in the longitudinal direction of the pipe casing 290. The heat pipe 200 has the same configuration other than the above, so that a description of the configuration will be omitted.

Next, a method for manufacturing the heat pipe 200 will be described.

Figure 12:
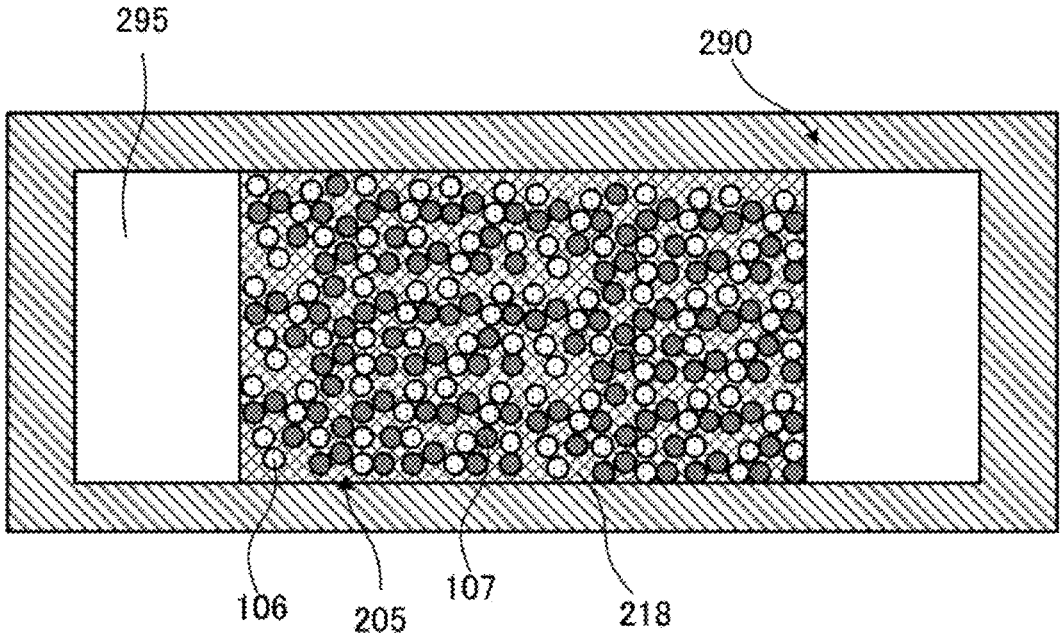
FIG. 12 is a cross-sectional view illustrating a state of a coating step performed in a method for manufacturing the heat pipe 200 illustrated in FIG. 11.

FIG. 12 is a cross-sectional view illustrating a state of a coating process performed in the method for manufacturing the heat pipe 200 illustrated in FIG. 11. The method for manufacturing the heat pipe 200 is different from the method for manufacturing the heat pipe 100 in step S1 illustrated in FIG. 4. The method for manufacturing the heat pipe 200 includes the same steps as in the method for manufacturing the heat pipe 100, so that a description of the steps will be omitted.

In the method for manufacturing the heat pipe 200, a green compact 205 is used instead of a metal paste 105. The green compact 205 contains first metal grains 106, second metal grains 107, and an organic component 218. The organic component 218 has a viscosity higher than the viscosity of the organic component 108. Other constitution of the organic component 218 is the same as the constitution of the organic component 108, so that a description of the organic component 218 will be omitted.

Then, as illustrated in FIG. 12, the green compact 205 is provided at the central portion of the pipe casing 290 in its transverse direction.

After passing through the steps S2 to S6, the heat pipe 200 is obtained in which the porous wick 230 is provided at the central portion of the pipe casing 290 in its transverse direction. As with the heat pipe 100, in the heat pipe 200, melted first metal and second metal react with each other by being heated at a temperature equal to or higher than a melting point of the first metal, so that an intermetallic compound composed of the first metal and the second metal is produced. An intermetallic compound phase 109 formed by this reaction constitutes the porous wick 230.

Thus, in the heat pipe 200, the porous wick 230 can be provided inside the pipe casing 290 at a temperature extremely lower than the above-mentioned sintering temperature.

Accordingly, the heat pipe 200 and a heat dissipating component provided with the heat pipe 200 achieve an effect similar to the effect of the heat pipe 100. Similarly, the method for manufacturing the heat pipe 200 achieves an effect similar to the effect of the method for manufacturing the heat pipe 100.

Hereinafter, a heat pipe 300 according to a third embodiment of the present invention will be described.

Figure 13:
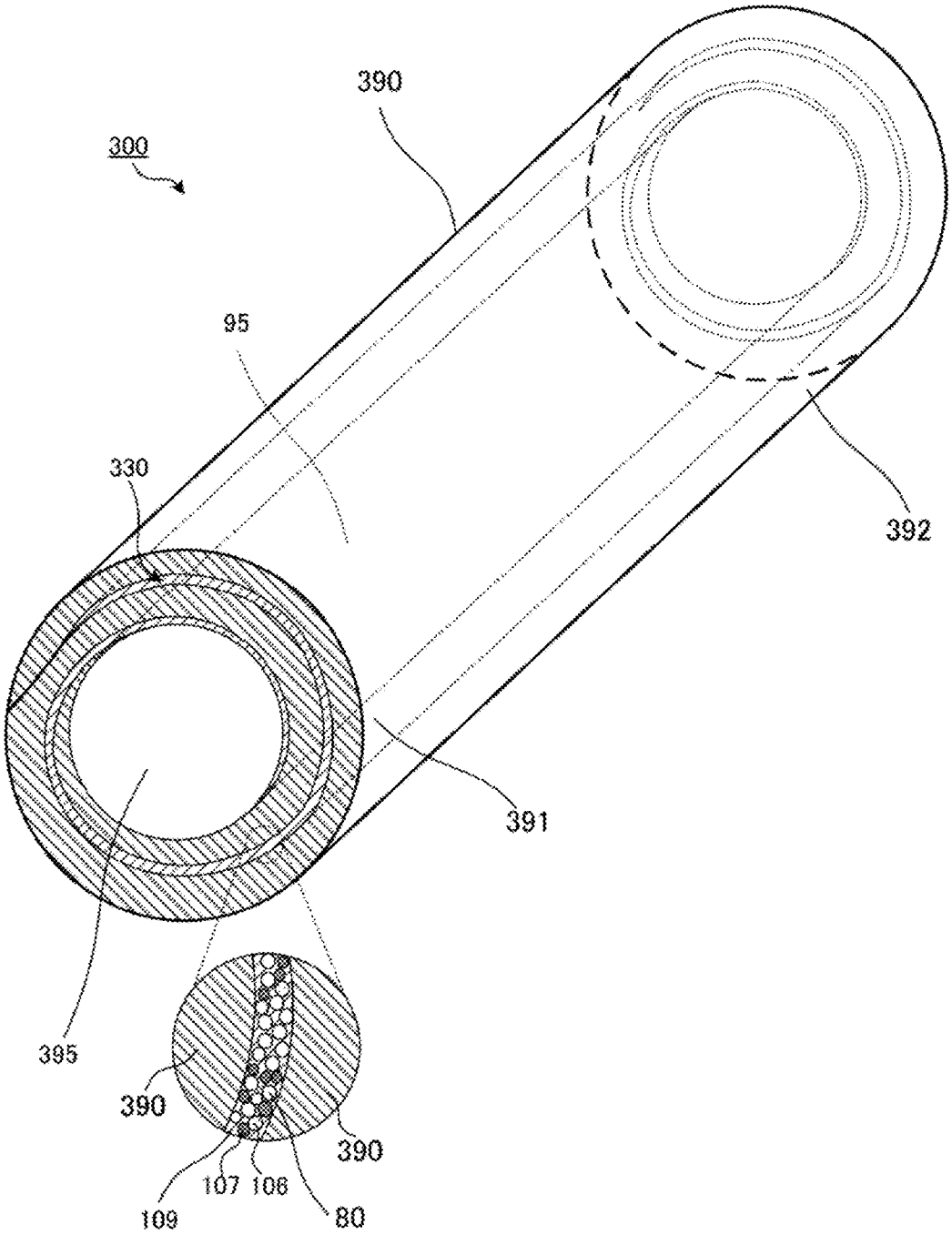
FIG. 13 is a perspective view illustrating an appearance of a heat pipe 300 according to a third embodiment of the present invention.

FIG. 13 is a perspective view illustrating an appearance of the heat pipe 300 according to the third embodiment of the present invention. In FIG. 13, an illustration of each of sealing members 191 and 192 is omitted for simplicity of description.

The heat pipe 300 is different from the heat pipe 100 in the shapes of a pipe casing 390 and a porous wick 330. The pipe casing 390 and the porous wick 330 each have a spiral shape in its cross-section. Then, each of the pipe casing 390 and the porous wick 330 extends in the longitudinal direction of the pipe casing 390 while maintaining substantially the same cross-sectional shape.

As with the porous wick 30 illustrated in FIGS. 1 and 2, the porous wick 330 interconnects a heating portion 391 and a cooling portion 392 in the pipe casing 390. Then, the pipe casing 390 and the porous wick 330 form a cavity 395 extending in the longitudinal direction of the pipe casing 390. The heat pipe 300 has the same configuration as that of the heat pipe 100, so that a description of the configuration will be omitted.

Next, a method for manufacturing the heat pipe 300 will be described.

Figure 14:
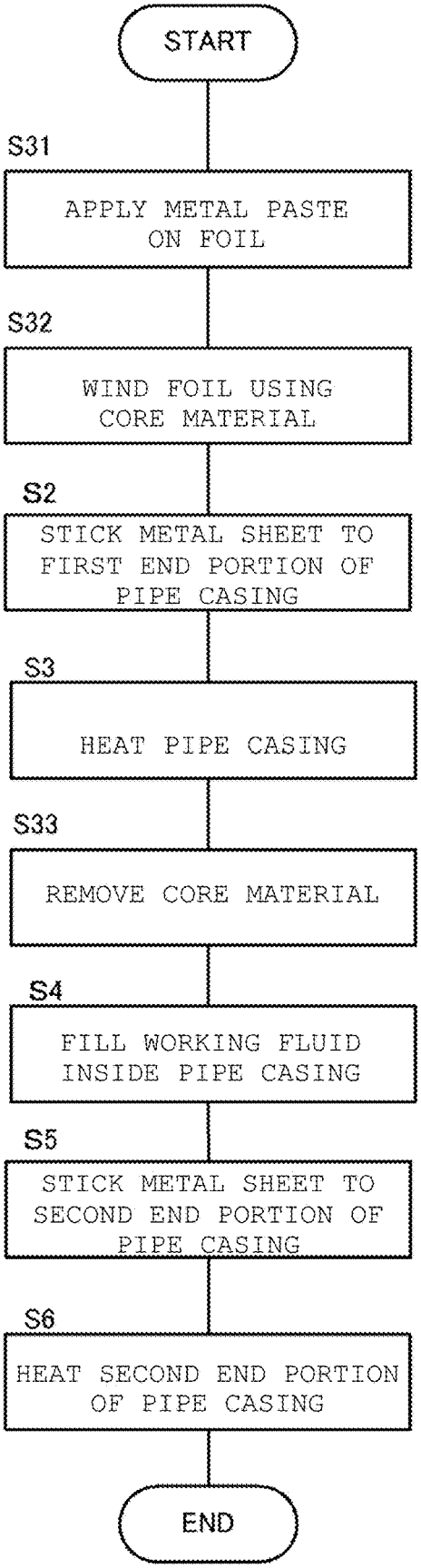
FIG. 14 is a flowchart illustrating a method for manufacturing the heat pipe 300 illustrated in FIG. 13.
Figure 15:
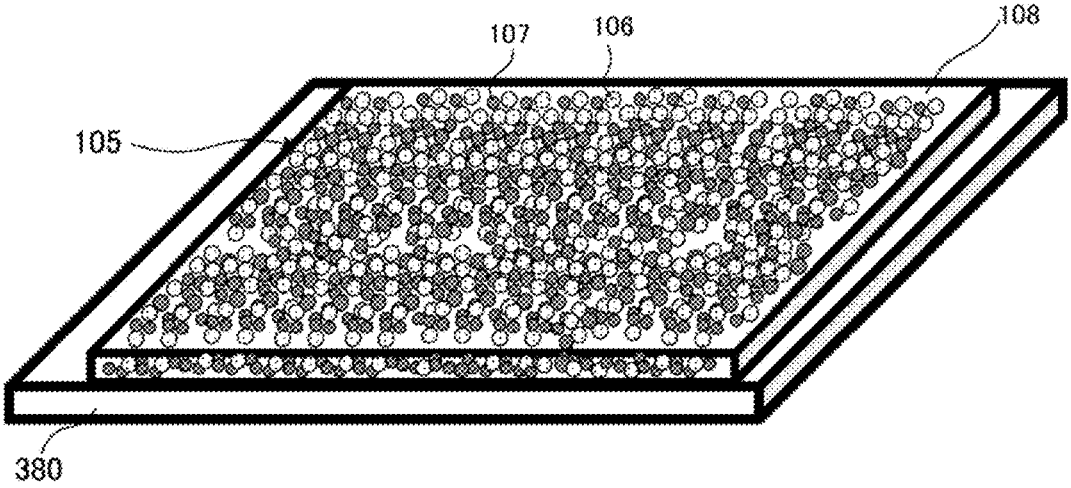
FIG. 15 is a cross-sectional view illustrating a state of a coating step illustrated in FIG. 14.
Figure 16:
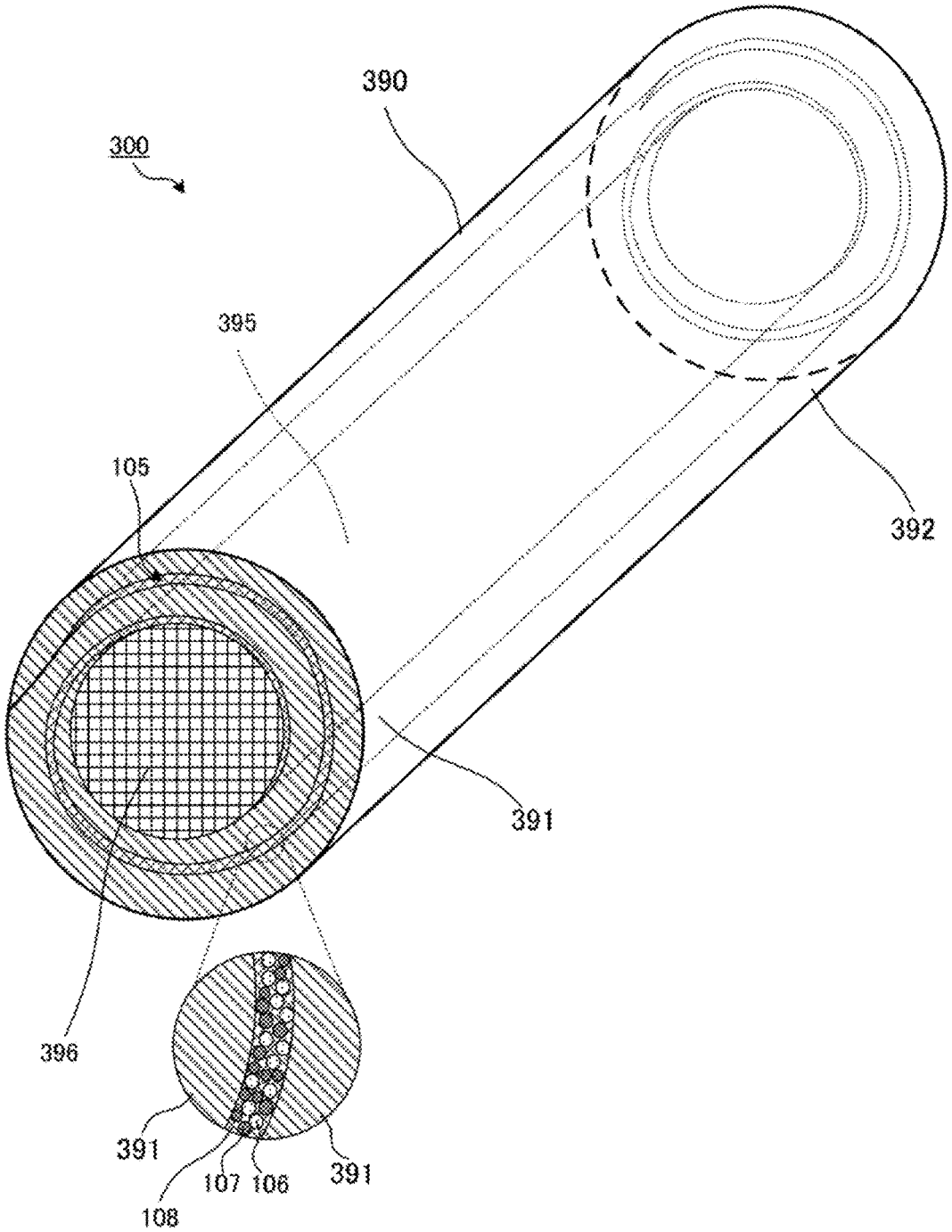
FIG. 16 is a cross-sectional view illustrating a state of a winding step illustrated in FIG. 14.

FIG. 14 is a flowchart illustrating the method for manufacturing the heat pipe 300 illustrated in FIG. 13. FIG. 15 is a cross-sectional view illustrating a state of a coating step illustrated in FIG. 14. FIG. 16 is a cross-sectional view illustrating a state of a winding step illustrated in FIG. 14.

The method for manufacturing the heat pipe 300 is different from the method for manufacturing the heat pipe 100 in that the step S1 illustrated in FIG. 4 is replaced with steps S31 to S33. The method for manufacturing the heat pipe 300 includes the same steps as in the method for manufacturing the heat pipe 100, so that a description of the steps will be omitted.

In the method for manufacturing the heat pipe 300, a core material 396 and a foil 380 are prepared. A material of the foil 380 is copper, for example.

Then, as illustrated in FIG. 15, a metal paste 105 is applied to a surface of the foil 380 (FIG. 14: S31).

Next, as illustrated in FIG. 16, the foil 380 is wound around the core material 396 such that the surface of the foil 380 provided with the metal paste 105 faces inward (FIG. 14: S32). As a result, the metal paste 105 and the pipe casing 390 each having a spiral cross-section are obtained.

Next, a metal sheet 155 is stuck to a first end portion 391 of the pipe casing 390 (S2: sticking step).

Subsequently, the pipe casing 390 is heated using, for example, a reflow device (S3: heating step). As a result, an intermetallic compound phase 109 is formed by the reaction between melted Sn and second metal grains 107, and then the porous wick 330 having a spiral cross-section is obtained.

Subsequently, after passing through the steps S2 and S3, the core material 396 is removed from the porous wick 330 and the pipe casing 390 (FIG. 14: S33). As a result, a region from which the core material 396 is removed becomes the cavity 395.

After passing through steps S4 to S6, the heat pipe 300 is obtained. As with the heat pipe 100, in the heat pipe 300, melted first metal and second metal react with each other by being heated at a temperature equal to or higher than a melting point of the first metal, so that an intermetallic compound composed of the first metal and the second metal is produced. The intermetallic compound phase 109 formed by this reaction constitutes the porous wick 330.

Thus, in the heat pipe 300, the porous wick 330 can be provided inside the pipe casing 390 at a temperature extremely lower than the above-mentioned sintering temperature.

Accordingly, the heat pipe 300 and a heat dissipating component provided with the heat pipe 300 achieve an effect similar to the effect of the heat pipe 100. Similarly, the method for manufacturing the heat pipe 300 achieves an effect similar to the effect of the method for manufacturing the heat pipe 100.

Hereinafter, a heat pipe 400 according to a fourth embodiment of the present invention will be described.

Figure 17:
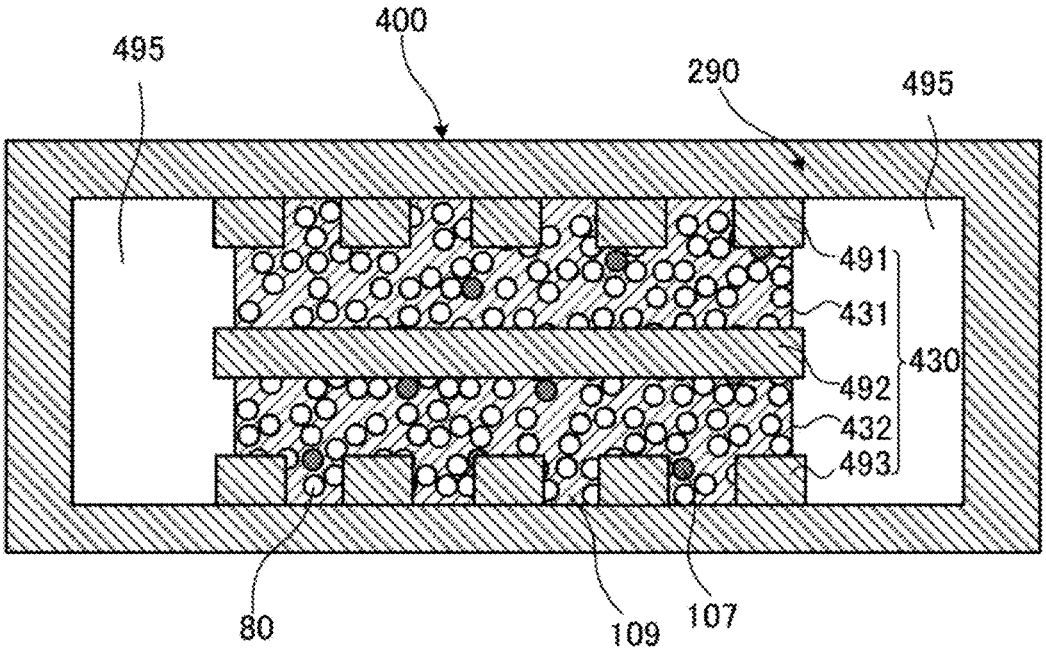
FIG. 17 is a cross-sectional view illustrating a central portion of a heat pipe 400 according to a fourth embodiment of the present invention.

FIG. 17 is a cross-sectional view illustrating a central portion of the heat pipe 400 according to the fourth embodiment of the present invention. The heat pipe 400 is obtained by replacing the porous wick 230 of the heat pipe 200 illustrated in FIG. 11 with a laminate 430. The laminate 430 is formed by laminating a foil 491, a porous wick 431, a foil 492, a porous wick 432, and a foil 493. A pipe casing 290 and the laminate 430 form a cavity 495 extending in the longitudinal direction of the pipe casing 290. The heat pipe 400 has the same configuration other than the above, so that a description of the configuration will be omitted.

Next, a method for manufacturing the heat pipe 400 will be described.

Figure 18:
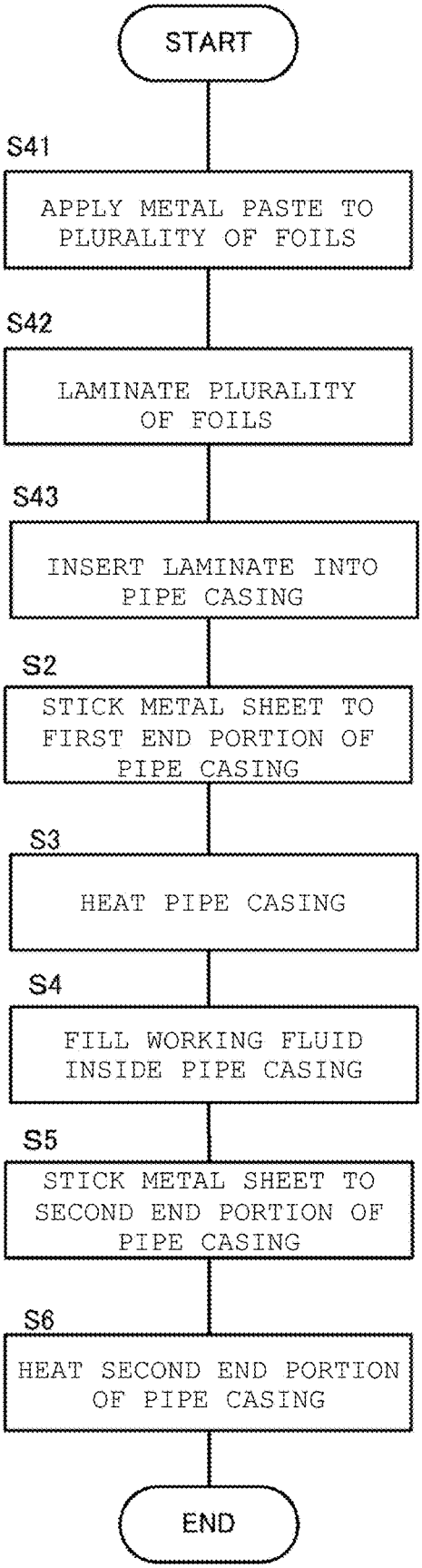
FIG. 18 is a flowchart illustrating a method for manufacturing the heat pipe 400 illustrated in FIG. 17.
Figure 19:
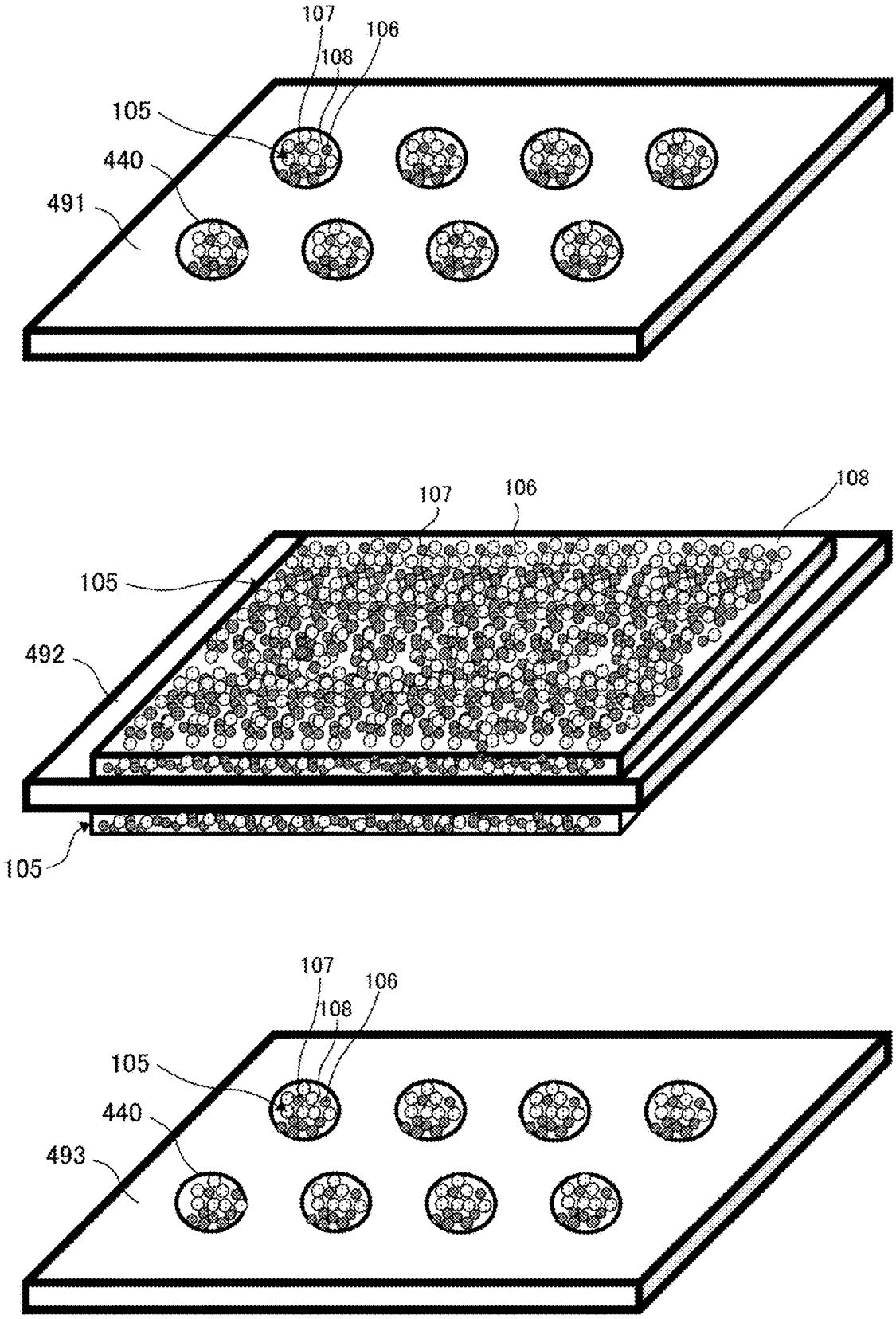
FIG. 19 is a perspective view illustrating an appearance of each of a plurality of foils 491, 492, and 493 prepared in the method for manufacturing the heat pipe 400, and a state of a coating step, illustrated in FIG. 18.
Figure 20:
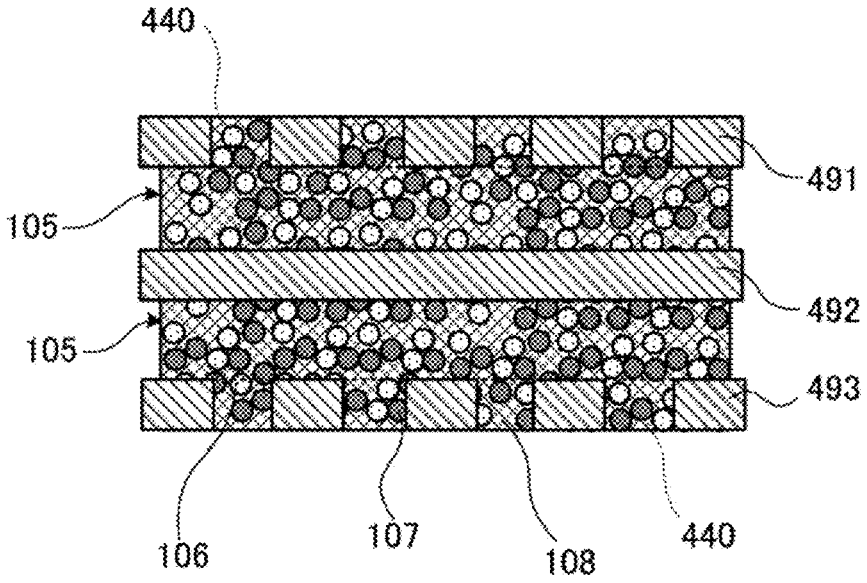
FIG. 20 is a cross-sectional view illustrating a state of a lamination step illustrated in FIG. 18.
Figure 21:
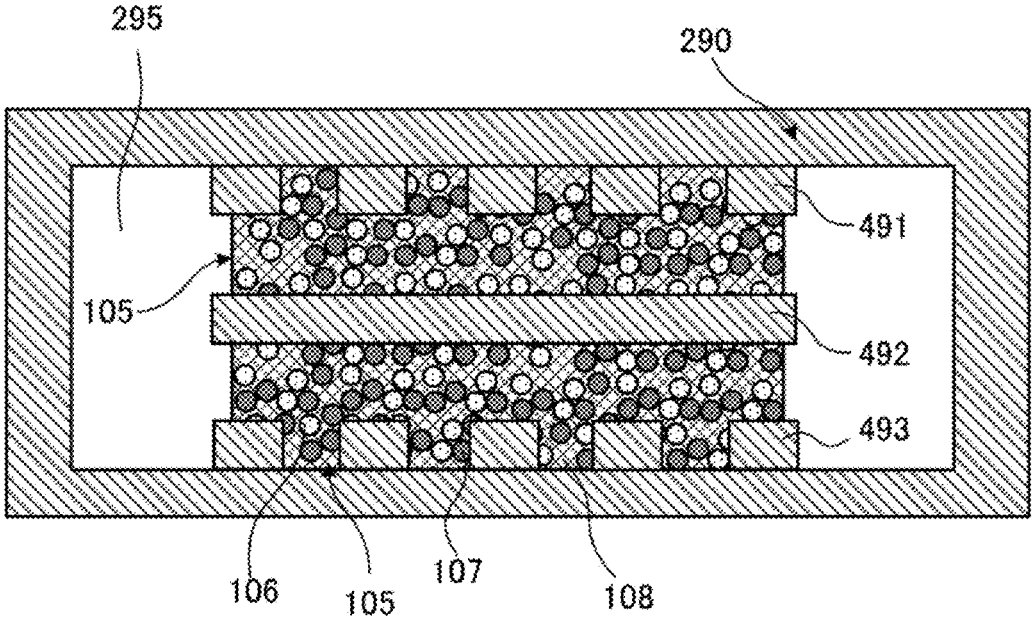
FIG. 21 is a cross-sectional view illustrating a state of an insertion step illustrated in FIG. 18.

FIG. 18 is a flowchart illustrating the method for manufacturing the heat pipe 400 illustrated in FIG. 17. FIG. 19 is a perspective view illustrating an appearance of each of a plurality of foils 491, 492, and 493 prepared in the method for manufacturing the heat pipe 400, and a state of a coating step, illustrated in FIG. 18. FIG. 20 is a cross-sectional view illustrating a state of a lamination step illustrated in FIG. 18. FIG. 21 is a cross-sectional view illustrating a state of an insertion step illustrated in FIG. 18.

As illustrated in FIG. 18, the method for manufacturing the heat pipe 400 is obtained by replacing the step S1 illustrated in FIG. 4 with steps S41 to S43. The method for manufacturing the heat pipe 400 includes the same steps as in the method for manufacturing the heat pipe 100, so that a description of the steps will be omitted.

In the method for manufacturing the heat pipe 400, as illustrated in FIG. 19, the foil 491, the foil 492, and the foil 493 are prepared. The foil 491 has a plurality of openings 440. The foil 493 has a plurality of openings 440. A material of each of the foil 491, the foil 492, and the foil 493 is copper, for example.

As illustrated in FIG. 19, a metal paste 105 is applied to the plurality of openings 440 of the foil 491, both surfaces of the foil 492, and the plurality of openings 440 of the foil 493 (FIG. 18: S41).

Then, as illustrated in FIG. 20, the foil 491, the foil 492, and the foil 493 are laminated (FIG. 18: S42).

Next, as illustrated in FIG. 21, the laminate of the foil 491, the foil 492, and the foil 493 is inserted into the pipe casing 290 (FIG. 18: S43).

Subsequently, a metal sheet 155 is stuck to an end portion of the pipe casing 290 (S2: sticking step).

Subsequently, the pipe casing 290 is heated using, for example, a reflow device (S3: heating step). As a result, an intermetallic compound phase 109 is formed by the reaction between melted Sn and second metal grains 107, and then porous wicks 431 and 432 are obtained.

After passing through steps S4 to S6, the heat pipe 400 is obtained. As with the heat pipe 100, in the heat pipe 400, melted first metal and second metal react with each other by being heated at a temperature equal to or higher than a melting point of the first metal, so that an intermetallic compound composed of the first metal and the second metal is produced. The intermetallic compound phase 109 formed by this reaction constitutes the porous wicks 431 and 432.

Thus, in the heat pipe 400, the porous wicks 431 and 432 can be provided inside the pipe casing 290 at a temperature extremely lower than the above-mentioned sintering temperature.

Accordingly, the heat pipe 400 and a heat dissipating component provided with the heat pipe 400 achieve an effect similar to the effect of the heat pipe 100. Similarly, the method for manufacturing the heat pipe 400 achieves an effect similar to the effect of the method for manufacturing the heat pipe 100.

While the three foils 491 to 493 are used in the method for manufacturing the heat pipe 400, the method is not limited to this configuration. In practice, three metal plates may be used, for example. In addition, the number of foils or metal plates to be laminated is not limited to three, and may be two or more.

Hereinafter, a heat pipe 500 according to a fifth embodiment of the present invention will be described.

Figure 22:
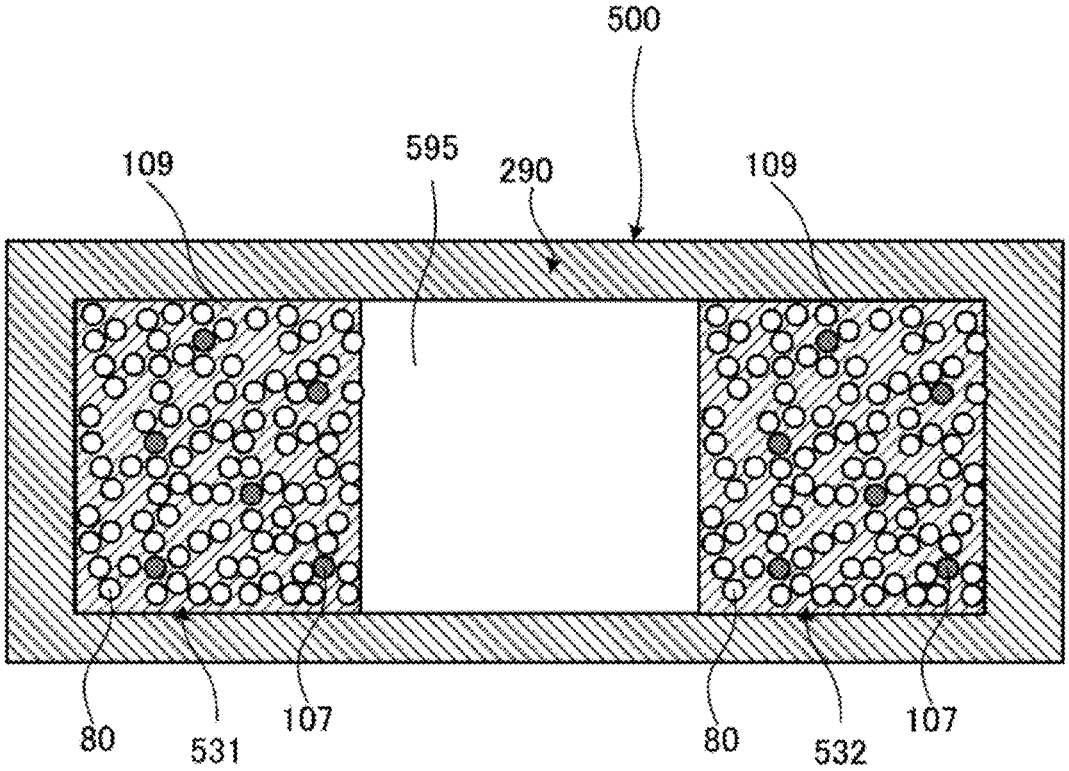
FIG. 22 is a cross-sectional view illustrating a central portion of a heat pipe 500 according to a fifth embodiment of the present invention.

FIG. 22 is a cross-sectional view illustrating a central portion of the heat pipe 500 according to the fifth embodiment of the present invention. The heat pipe 500 is obtained by replacing the porous wick 230 of the heat pipe 200 illustrated in FIG. 11 with porous wicks 531 and 532. A pipe casing 290 and the porous wicks 531 and 532 form a cavity 595 extending in the longitudinal direction of the pipe casing 290. The heat pipe 500 has the same configuration other than the above, so that a description of the configuration will be omitted.

Next, a method for manufacturing the heat pipe 500 will be described.

Figure 23:
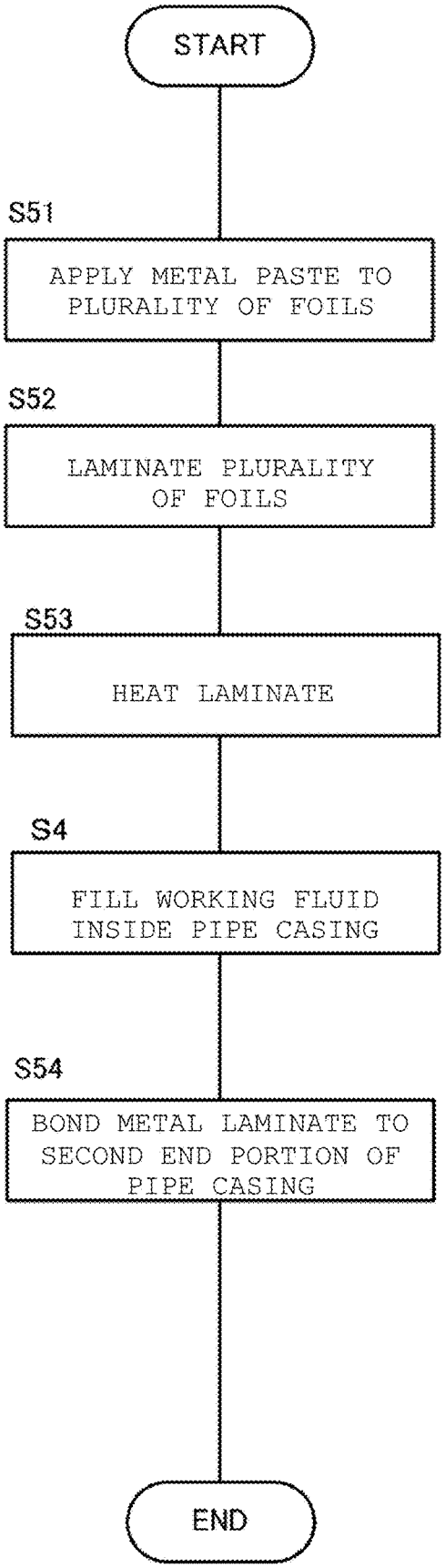
FIG. 23 is a flowchart illustrating a method for manufacturing the heat pipe 500 illustrated in FIG. 22.
Figure 24:
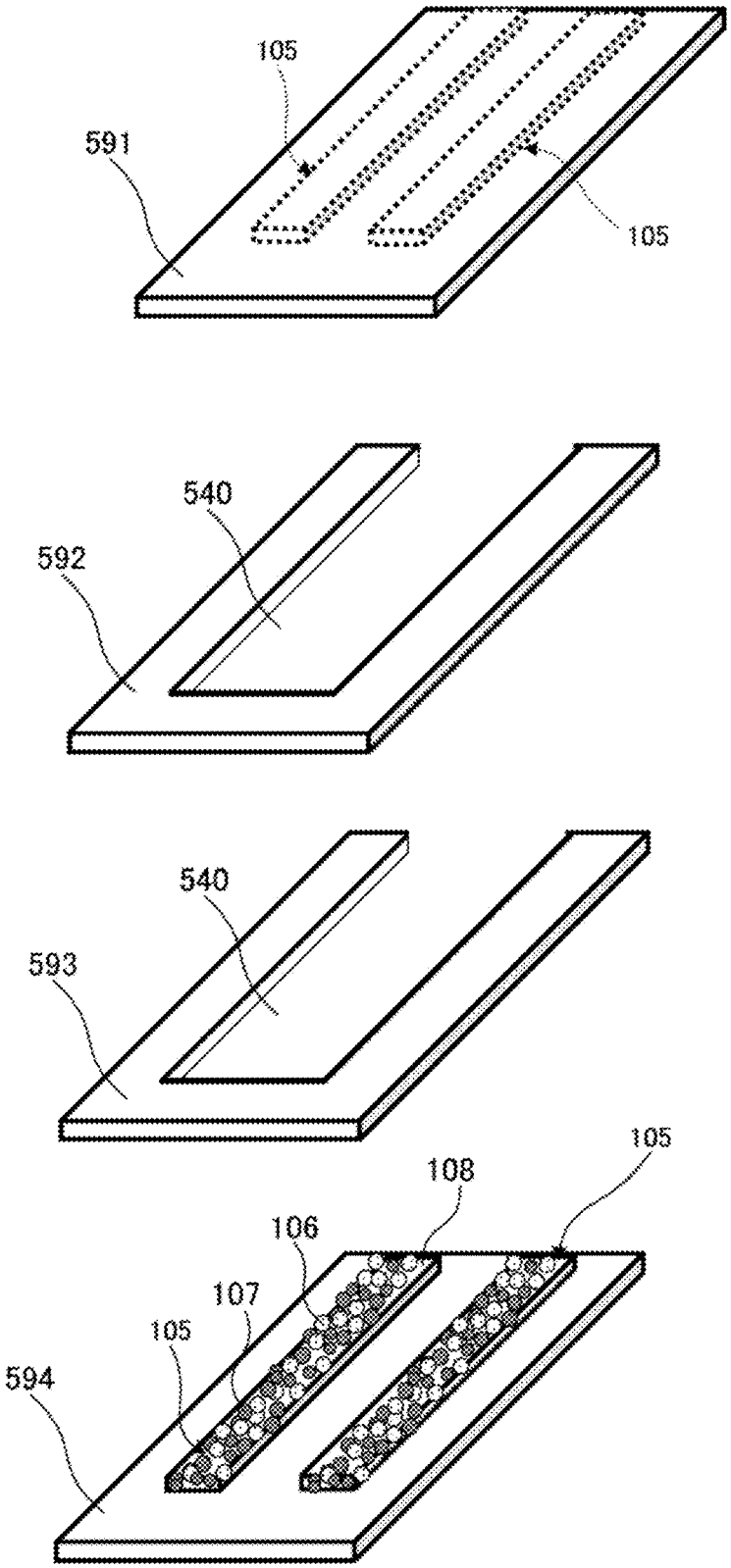
FIG. 24 is a perspective view illustrating an appearance of each of a plurality of foils 591, 592, 593, and 594 prepared in the method for manufacturing the heat pipe 500, and a state of a coating step, illustrated in FIG. 23.
Figure 25:
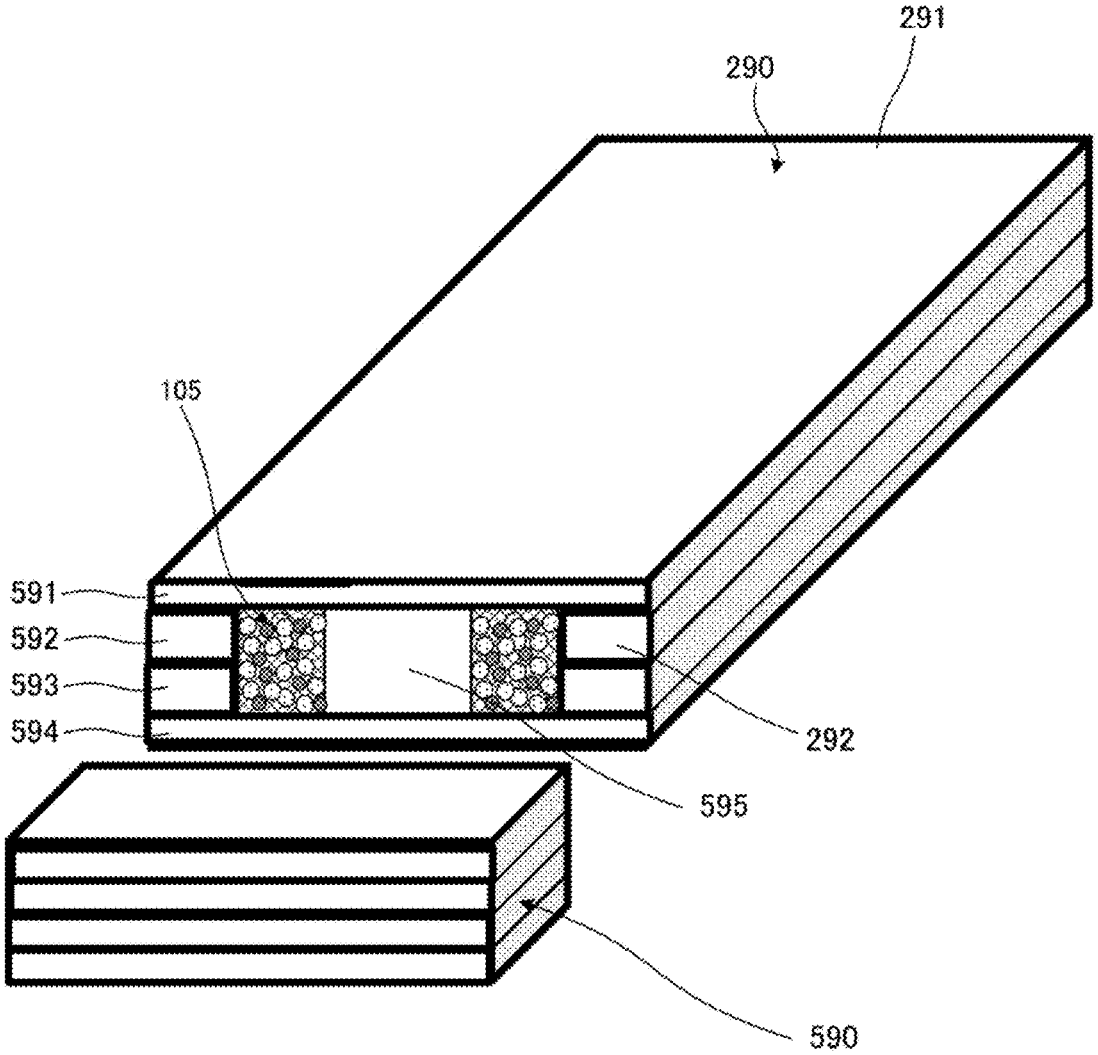
FIG. 25 is a cross-sectional view illustrating a state of a lamination step illustrated in FIG. 23.

FIG. 23 is a flowchart illustrating the method for manufacturing the heat pipe 500 illustrated in FIG. 22. FIG. 24 is a perspective view illustrating an appearance of each of a plurality of foils 591, 592, 593, and 594 prepared in the method for manufacturing the heat pipe 500, and a state of a coating step, illustrated in FIG. 23. FIG. 25 is a cross-sectional view illustrating a state of a lamination step illustrated in FIG. 23.

In the method for manufacturing the heat pipe 500, the foil 591, the foil 592, the foil 593, and the foil 594 are prepared as illustrated in FIG. 24 in order to obtain the structure illustrated in FIG. 22. The foil 592 has an opening 540. The foil 593 has an opening 540. A material of each of the foil 591, the foil 592, the foil 593, and the foil 594 is copper, for example.

As illustrated in FIG. 24, a metal paste 105 is applied to a surface of the foil 591, which faces the foil 594, and a surface of the foil 594, which faces the foil 591 (FIG. 23: S51).

Then, as illustrated in FIG. 25, the foil 591, the foil 592, the foil 593, and the foil 594 are laminated (FIG. 23: S52).

Next, the laminate of the foil 591, the foil 592, the foil 593, and the foil 594 is heated using, for example, a reflow device (FIG. 23: S53). As a result, an intermetallic compound phase 109 is formed by the reaction between melted Sn and second metal grains 107. Then, porous wicks 531 and 532, and the pipe casing 290, as illustrated in FIG. 22, are obtained. After the reflow device stops heating, the porous wicks 531 and 532, and the pipe casing 290 naturally cool to room temperature.

Subsequently, a working fluid is filled inside the pipe casing 290 (S4: filling step).

Subsequently, in order to seal a second end portion 292 of the pipe casing 290, a laminate 590 illustrated in FIG. 25 is bonded to the second end portion 292 of the pipe casing 290 (S54: bonding step). The laminate 590 is formed by laminating four foils. This bonding is performed by heating a bonding surface of the second end portion 292 of the pipe casing 290 and a bonding surface of the laminate 590 after activating the bonding surfaces, for example.

The heat pipe 500 is obtained by the above manufacturing method. As with the heat pipe 100, in the heat pipe 500, melted first metal and second metal react with each other by being heated at a temperature equal to or higher than a melting point of the first metal, so that an intermetallic compound composed of the first metal and the second metal is produced. An intermetallic compound phase 109 formed by this reaction constitutes the porous wicks 531 and 532.

Thus, in the heat pipe 500, the porous wicks 531 and 532 can be provided inside the pipe casing 290 at a temperature extremely lower than the above-mentioned sintering temperature.

Accordingly, the heat pipe 500 and a heat dissipating component provided with the heat pipe 500 achieve an effect similar to the effect of the heat pipe 100. Similarly, the method for manufacturing the heat pipe 500 achieves an effect similar to the effect of the method for manufacturing the heat pipe 100.

While the four foils 591 to 594 are used in the method for manufacturing the heat pipe 500, the method is not limited to this configuration. In practice, four metal plates may be used, for example. In addition, the number of foils or metal plates to be laminated is not limited to four, and may be two or more.

Hereinafter, a heat pipe 600 according to a sixth embodiment of the present invention will be described.

Figure 26:
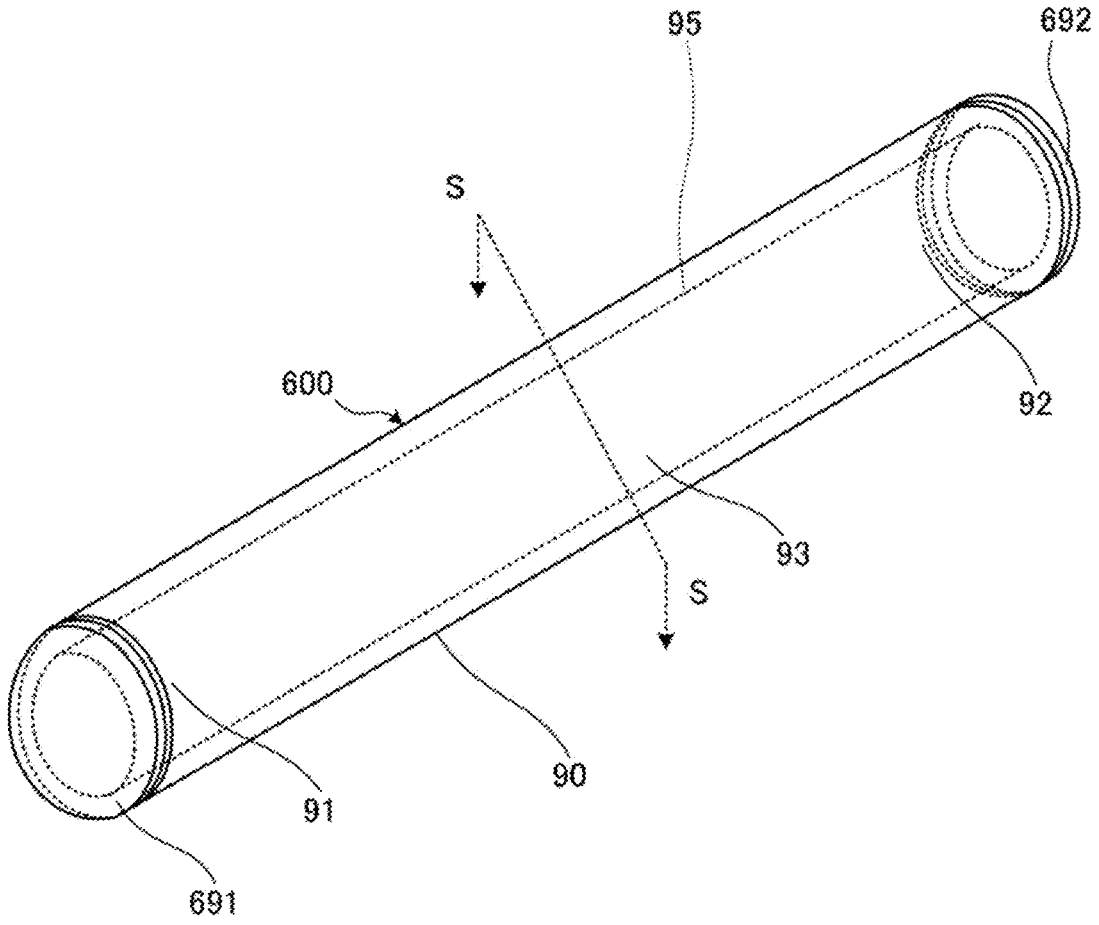
FIG. 26 is a perspective view illustrating an appearance of a heat pipe 600 according to a sixth embodiment of the present invention.
Figure 27:
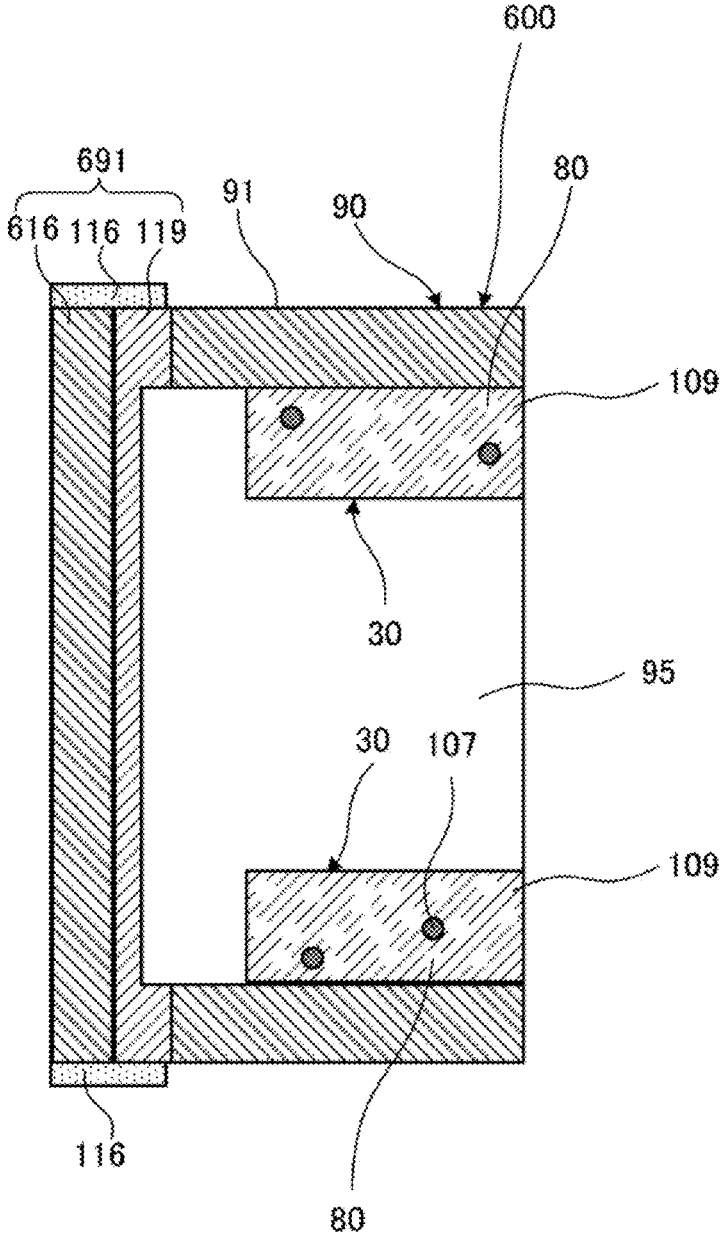
FIG. 27 is a cross-sectional view illustrating a first end portion 91 of the heat pipe 600 illustrated in FIG. 26.

FIG. 26 is a perspective view illustrating an appearance of the heat pipe 600 according to the sixth embodiment of the present invention. FIG. 27 is a cross-sectional view illustrating a first end portion 91 of the heat pipe 600 illustrated in FIG. 26. The heat pipe 600 is different from the heat pipe 100 in sealing members 691 and 692. The heat pipe 600 has the same configuration other than the above, so that a description of the configuration will be omitted.

Both end portions 91 and 92 of the pipe casing 90 are sealed by the sealing members 691 and 692, respectively. The sealing member 691 is constituted of a second metal foil 616, a first metal foil 116, and an intermetallic compound phase 119.

Regarding the heat pipe 600, the constitution of the second end portion 92 is the same as that of the first end portion 91, and the constitution of the sealing member 692 is the same as that of the sealing member 691. Thus, a description of the second end portion 92 and the sealing member 692 of the pipe casing 90 will be omitted.

Next, a method for manufacturing the heat pipe 600 will be described.

Figure 28:
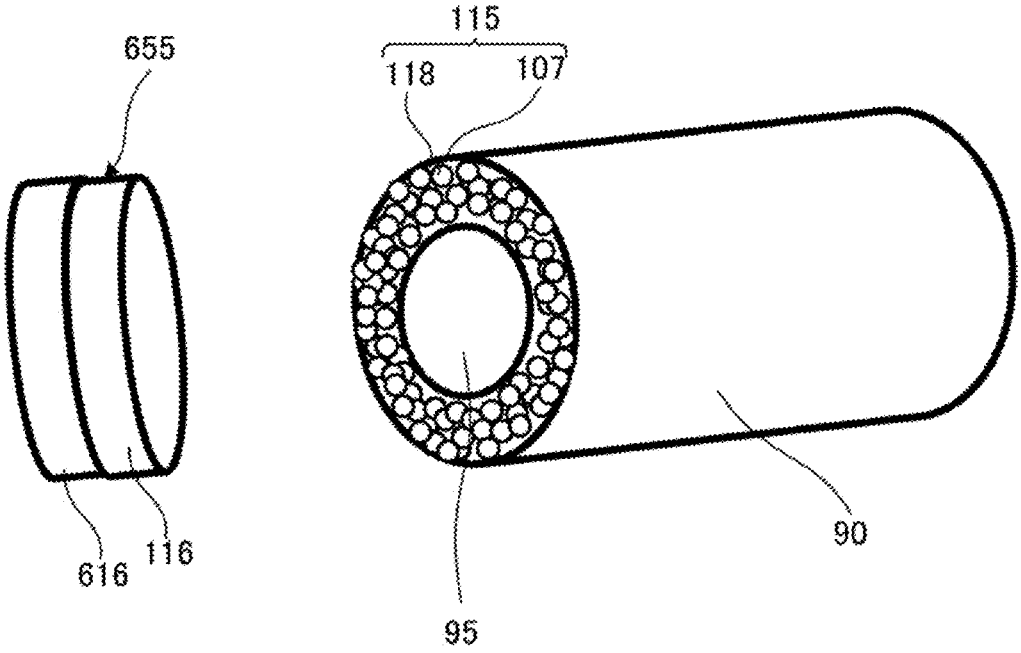
FIG. 28 is a cross-sectional view illustrating a state of a sticking step in a method for manufacturing the heat pipe 600 illustrated in FIG. 26.

FIG. 28 is a cross-sectional view illustrating a state of a sticking step in the method for manufacturing the heat pipe 600 illustrated in FIG. 26. The method for manufacturing the heat pipe 600 is different from the method for manufacturing the heat pipe 100 in that a metal sheet 655 and a coating film 115 are used instead of the metal sheet 155 illustrated in FIG. 6(B) in the sticking steps S2 and S5 illustrated in FIG. 4. As illustrated in FIG. 28, the metal sheet 655 includes the second metal foil 616 and the first metal foil 116. The heat pipe 600 has the same configuration other than the above, so that a description of the configuration will be omitted.

In the method for manufacturing of the heat pipe 600, after the coating film 115 is applied to the first end portion 91 of the pipe casing 90 as illustrated in FIG. 28, the metal sheet 655 is stuck to the first end portion 91 of the pipe casing 90 (FIG. 4: S2). As described above, the coating film 115 contains second metal grains 107 uniformly dispersed in an organic component 118.

Subsequently, the first end portion 91 of the pipe casing 90 is heated using, for example, a reflow device (FIG. 4: S3). As a result, an intermetallic compound phase 119 is formed by the reaction between melted Sn and the second metal grains 107, and the sealing member 691 is provided at the first end portion 91 as illustrated in FIGS. 26 and 27.

Similarly, after the coating film 115 is applied to the second end portion 92 of the pipe casing 90, the metal sheet 655 is stuck to the second end portion 92 of the pipe casing 90 (FIG. 4: S5).

Subsequently, the second end portion 92 of the pipe casing 90 is heated, for example, using a reflow device (FIG. 4: S3). As a result, an intermetallic compound phase 119 is formed by the reaction between melted Sn and the second metal grains 107, and the sealing member 692 is provided at the second end portion 92 as illustrated in FIG. 26.

The heat pipe 600 is obtained by the above manufacturing method. As with the heat pipe 100, in the heat pipe 600, melted first metal and second metal react with each other by being heated at a temperature equal to or higher than a melting point of the first metal, so that an intermetallic compound composed of the first metal and the second metal is produced. The intermetallic compound phase 119 formed by this reaction constitutes the sealing members 691 and 692.

Thus, in the heat pipe 600, the sealing members 691 and 692 can be provided at the both end portions 91 and 92 of the pipe casing 90, respectively, at a temperature extremely lower than the above-described sintering temperature. In addition, the intermetallic compound phase 119 of each of the sealing members 691 and 692 has a dense structure with an extremely low porosity (refer to FIG. 10). Thus, the heat pipe 600 can reliably prevent leakage of a working fluid sealed in the pipe casing 90. The sealing members 691 and 692 are also excellent in impact resistance.

Accordingly, the heat pipe 600 and a heat dissipating component provided with the heat pipe 600 achieve an effect similar to the effect of the heat pipe 100. Similarly, the method for manufacturing the heat pipe 600 achieves an effect similar to the effect of the method for manufacturing the heat pipe 100.

Hereinafter, a heat pipe 700 according to a seventh embodiment of the present invention will be described.

Figure 29:
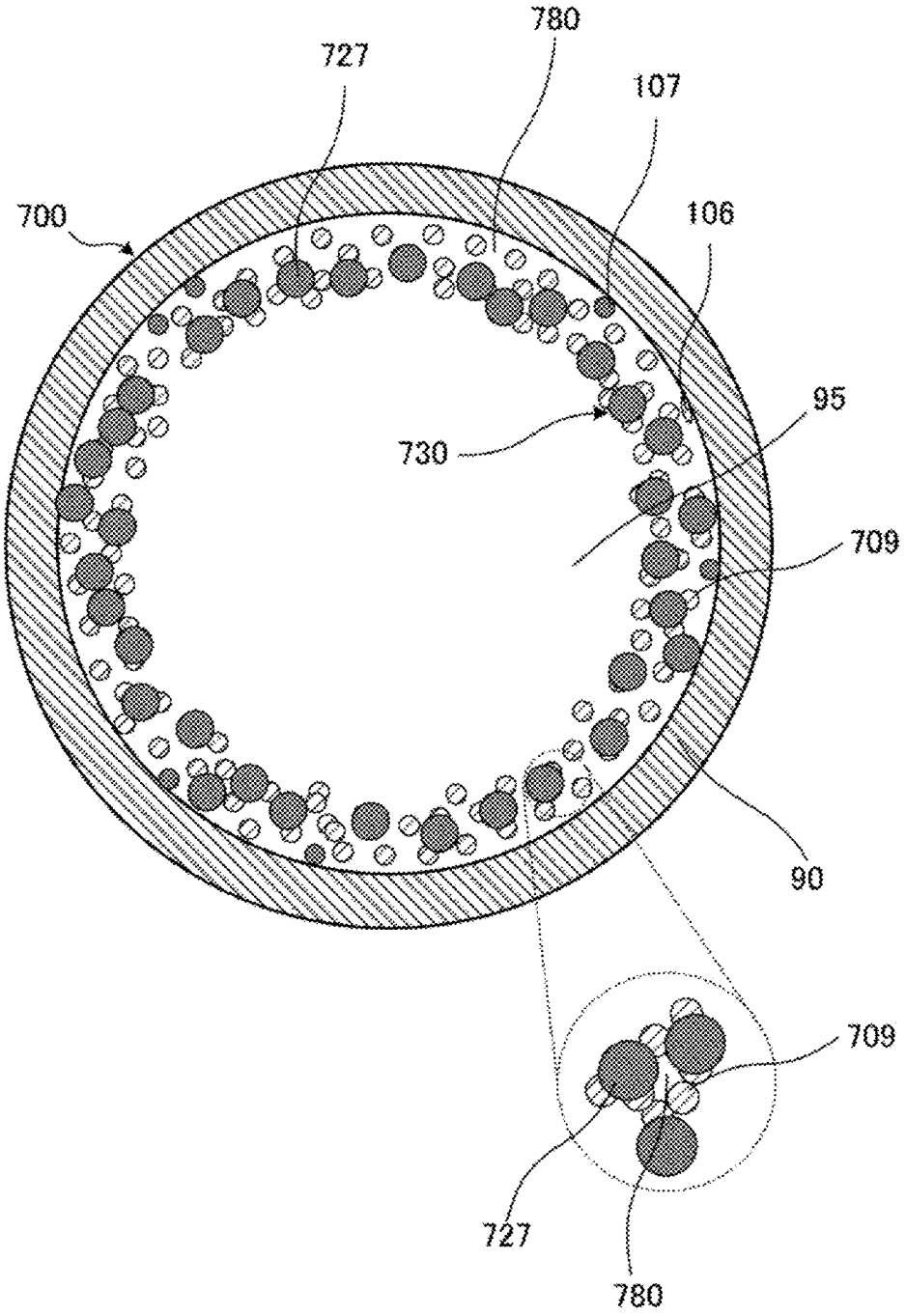
FIG. 29 is a cross-sectional view illustrating a central portion of a heat pipe 700 according to a seventh embodiment of the present invention.

FIG. 29 is a cross-sectional view illustrating a central portion of the heat pipe 700 according to the seventh embodiment of the present invention. The heat pipe 700 is different from the heat pipe 100 in that the porosity of a porous wick 730 is higher than the porosity of the porous wick 30. The porous wick 730 has pores 780. The porous wick 730 includes first metal grains 106 constituted of the first metal, second metal grains 107 constituted of the above-described second metal, third metal grains 727 constituted of third metal, and intermetallic compound grains 709 each composed of an intermetallic compound. In the porous wick 730, a plurality of the intermetallic compound grains 709 bond to the third metal grains 727.

As with the porous wick 30 illustrated in FIGS. 1 and 2, the porous wick 730 extends in the longitudinal direction of a pipe casing 90 to interconnect a heating portion 91 and a cooling portion 92 in the pipe casing 90. Then, the pipe casing 90 and the porous wick 730 form a cavity 95 extending in the longitudinal direction of the pipe casing 90. The heat pipe 700 has the same configuration other than the above, so that a description of the configuration will be omitted.

Next, a method for manufacturing the heat pipe 700 will be described.

Figure 30:
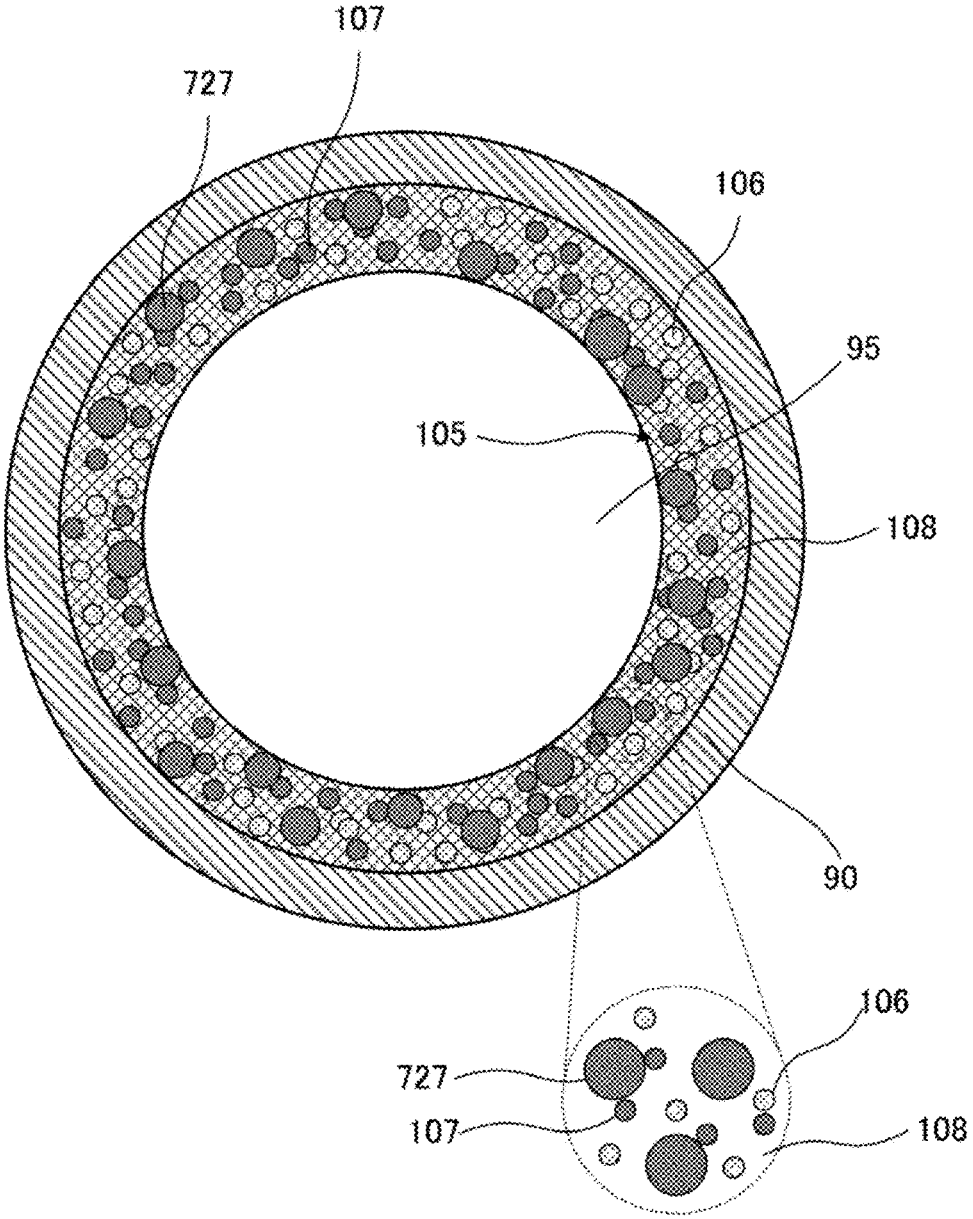
FIG. 30 is a cross-sectional view illustrating a state of a coating step performed in a method for manufacturing the heat pipe 700 illustrated in FIG. 29.

FIG. 30 is a cross-sectional view illustrating a state of a coating step performed in the method for manufacturing the heat pipe 700 illustrated in FIG. 29. The method for manufacturing the heat pipe 700 is different from the method for manufacturing the heat pipe 100 in the step S1 illustrated in FIG. 4. The method for manufacturing the heat pipe 700 includes the same steps as in the method for manufacturing the heat pipe 100, so that a description of the steps will be omitted.

In the method for manufacturing the heat pipe 700, a metal paste 705 is used instead of a metal paste 105. Then, as illustrated in FIG. 30, the metal paste 705 is provided in a central portion of a pipe casing 90 in its lateral direction.

The metal paste 705 contains third metal grains 727 in addition to first metal grains 106, second metal grains 107, and an organic component 108. The third metal is Cu, for example.

Here, each of the third metal grains 727 satisfies the following conditions.

The third metal has a melting point higher than a melting point of the first metal.

The third metal grain 727 has a diameter larger than a diameter of the second metal grain 107.

The third metal chemically reacts with the first metal.

An intermetallic compound is formed on a surface of the third metal grain 727.

The reaction rate at the time when the third metal grains 727 react with the first metal grains 106 to form an intermetallic compound is lower than the reaction rate at the time when the second metal grains 107 react with the first metal grains 106 to form an intermetallic compound.

The third metal grain 727 is insoluble in a working fluid such as water.

When the third metal grain 727 has a diameter larger than the diameter of the second metal grain 107, the second metal grain 107 has a specific surface area larger than that of the third metal grain 727. Then, the first metal grains 106 preferentially react with the second metal grains 107 having a large specific surface area, so that an intermetallic compound composed of the second metal grains 107 and the first metal grains 106 tends to be easily formed. Accordingly, the third metal grains 727 can be bound with each other via the intermetallic compound. In addition, an increase in size of the third metal grain 727 increases a gap between grains, so that the pore 780 after heating can be made large.

After passing through steps S2 to S6 after the coating step is finished, the heat pipe 700 is obtained in which a porous wick 730 is provided at the central portion of the pipe casing 90 in its lateral direction. As with the heat pipe 100, in the heat pipe 700, melted first metal and second metal react with each other by being heated at a temperature equal to or higher than a melting point of the first metal, so that an intermetallic compound composed of the first metal and the second metal is produced. The intermetallic compound grains 709 produced by this reaction constitute the porous wick 730.

Thus, in the heat pipe 700, the porous wick 730 can be provided inside the pipe casing 90 at a temperature extremely lower than the above-mentioned sintering temperature.

Accordingly, the heat pipe 700 and a heat dissipating component provided with the heat pipe 700 achieve an effect similar to the effect of the heat pipe 100. Similarly, the method for manufacturing the heat pipe 700 achieves an effect similar to the effect of the method for manufacturing the heat pipe 100.

While the third metal grain 727 is constituted of Cu in the present embodiment, the present invention is not limited thereto. In practice, the third metal may be metal other than Cu. For example, the third metal may be Ni. In addition, the second metal may be CuNiCo, and the third metal may be CuNi. While all the third metal grains 727 are drawn in a spherical shape in FIGS. 29 and 30, they may be indefinite shapes.

Another Embodiment

While the above-described embodiments each show an example in which the pipe casing is a cylindrical shape, a rectangular cylindrical shape, or the like, the embodiments are not limited thereto. The pipe casing may have a shape as follows: a tubular shape with a polygonal cross-section, an elliptical cross-section, or the like; a tapered tubular shape having a conical shape as its external shape; and a tubular shape in which an area of an opening and an area of a side wall are substantially equal to each other.

In addition, while the metal paste 105 is in the form of a paste in the manufacturing method of each of the present embodiments, the form of the metal paste 105 is not limited thereto. In practice, the metal composition may be in the form of putty, for example.

Further, while the material of the first metal grains 106 is Sn alone in the manufacturing method of each of the present embodiments, the material is not limited thereto. In practice, the material of the first metal grains 106 may be a Sn-based alloy. The Sn-based alloy is, for example, a SnAgCu alloy, a SnAg alloy, a SnCu alloy, a SnBi alloy, a SnSb alloy, a SnAu alloy, a SnPb alloy, or a SnZn alloy.

Furthermore, while the material of the second metal grains 107 is a CuNi alloy in the manufacturing method of each of the present embodiments, the material is not limited thereto. In practice, the material of the second metal grains 107 may be at least one kind of alloy selected from the group consisting of CuMn alloy grains, CuAl alloy grains, and CuCr alloy grains, for example. It is preferable to use Cu alloy grains each with a ratio of 5% to 20% by weight of Ni, Mn, Al or Cr.

When CuMn alloy grains are used, an intermetallic compound containing at least two kinds selected from the group consisting of Cu, Mn, and Sn is produced by the reaction between melted Sn and the CuMn alloy grains. This intermetallic compound is $(Cu,Mn)_6Sn_5$, $Cu_4Mn_2Sn_5$, $Cu_5MnSn_5$, $(Cu,Mn)_3Sn$, $Cu_2MnSn$, or $CuMn_2Sn$, for example.

While hot air heating is performed in the heating step of each of the present embodiments, the configuration of the heating step is not limited thereto. In practice, far infrared heating or high frequency induction heating may be performed, or a hot plate may be used, for example.

In addition, while hot air heating is performed in the atmosphere in the heating step of each of the present embodiments, the configuration of the heating step is not limited thereto. In practice, hot air heating may be performed in $N_2$, $H_2$, formic acid, or in vacuum, for example.

Further, while pressure is not applied during heating in the heating step of each of the present embodiments, the configuration of the heating step is not limited thereto. In practice, about several MPa may be applied during heating, for example. In this case, a dense intermetallic compound is obtained and the bonding strength increases.

Finally, the above embodiments each should be considered as an example in all respects and not restrictive. The scope of the present invention is not indicated by the above-described embodiments, but by claims. In addition, the scope of the present invention includes a scope equivalent to the claims.

DESCRIPTION OF REFERENCE SYMBOLS

30, 730: porous wick
80, 780: pore
90: pipe casing
91: first end portion (heating portion)
92: second end portion (cooling portion)
93: central portion
95: cavity
100, 200, 300, 400, 500, 600, 700: heat pipe
105, 705: metal paste
106: first metal grain
107: second metal grain
108: organic component
109: intermetallic compound phase
110: metal component
115: coating film
116: first metal foil
118: organic component
119: intermetallic compound phase
155: metal sheet
191, 192: sealing member
205: green compact
218: organic component
230: porous wick
250: heating temperature
290: pipe casing
291: first end portion (heating portion)
292: second end portion (cooling portion)
295: cavity
330: porous wick
380: foil
390: pipe casing
391: first end portion (heating portion)
392: second end portion (cooling portion)
395: cavity
396: core material
430: laminate
431, 432: porous wick
440: opening

491, 492, 493: foil
495: cavity
531: porous wick
540: opening
590: laminate
591, 592, 593, 594: foil
595: cavity
616: second metal foil
655: metal sheet
691, 692: sealing member
709: intermetallic compound grain
727: third metal grain

The invention claimed is:

1. A heat pipe comprising:

a pipe casing filled with a working fluid; and a porous wick inside the pipe casing, wherein the porous wick includes an intermetallic compound formed from at least a first metal and a second metal having a melting point higher than a melting point of the first metal, and the porous wick further includes a third metal having a melting point higher than the melting point of the first metal, and wherein the third metal has a diameter larger than a diameter of the second metal, and the third metal is chemically reactive with the first metal.

2. The heat pipe according to claim 1, wherein the porous wick comprises a material containing the first metal, the second metal, and the intermetallic compound.

3. The heat pipe according to claim 1, wherein the porous wick has a porosity of 20% or more.

4. The heat pipe according to claim 1, wherein the first metal is at least one kind of metal selected from Sn and a Sn-based alloy; and the second metal is at least one kind of alloy selected from a CuNi alloy, a CuMn alloy, a CuAl alloy, and a CuCr alloy.

5. A heat dissipating component comprising the heat pipe according to claim 1.

6. The heat pipe according to claim 1, further comprising:

a sealing member that seals the pipe casing;

wherein the intermetallic compound is a first intermetallic compound, and the sealing member includes a second intermetallic compound formed from at least a fourth metal and a fifth metal having a melting point higher than a melting point of the fourth metal.

7. The heat pipe according to claim 6, wherein the sealing member seals an end portion of the pipe casing.

8. The heat pipe according to claim 6, wherein the sealing member comprises a material containing the fourth metal and the second intermetallic compound.

9. The heat pipe according to claim 6, wherein the fourth metal is at least one kind of metal selected from Sn and a Sn-based alloy; and the fifth metal is at least one kind of alloy selected from a CuNi alloy, a CuMn alloy, a CuAl alloy, and a CuCr alloy.

10. A heat dissipating component comprising the heat pipe according to claim 6.

11. A method for manufacturing a heat pipe, the method comprising:

providing a metal composition inside a pipe casing, the metal composition containing a first metal and a second metal having a melting point higher than a melting point of the first metal, the metal composition further containing a third metal having a melting point higher than the melting point of the first metal, and wherein the third metal has a diameter larger than a diameter of the second metal, and the third metal is chemically reactive with the first metal; and heating the metal compound and causing the first metal and the second metal to react with each other to form a porous wick comprising a material containing an intermetallic compound inside the pipe casing.

12. The method for manufacturing a heat pipe according to claim 11, wherein the metal composition is in a paste state, and the metal composition is applied to the inside of the pipe casing while in the paste state.

13. The method for manufacturing a heat pipe according to claim 11, wherein the metal composition contains a flux.

14. The method for manufacturing a heat pipe according to claim 11, wherein, in the heating, the metal composition is heated to a temperature within a range of equal to or higher than the melting point of the first metal and equal to or lower than the melting point of the second metal.

15. The method for manufacturing a heat pipe according to claim 11, wherein the metal composition is a first metal composition and the intermetallic compound is a first intermetallic compound, the method further comprising:

providing a second metal composition in an end portion of the pipe casing, the second metal composition containing a fourth metal and a fifth metal having a melting point higher than the melting point of the fourth metal; and heating the second metal compound and causing the fourth metal and the fifth metal to react with each other to form a sealing material containing a second intermetallic compound inside the pipe casing.

16. The method for manufacturing a heat pipe according to claim 15, wherein the second metal composition contains a flux.

17. The method for manufacturing a heat pipe according to claim 15, wherein in the heating, the second metal composition is heated to a temperature within a range of equal to or higher than the melting point of the fourth metal and equal to or lower than the melting point of the fifth metal.

* * * * *